US010086621B2

(12) United States Patent
Kobayashi et al.

(10) Patent No.: US 10,086,621 B2
(45) Date of Patent: Oct. 2, 2018

(54) LIQUID CARTRIDGE HAVING MOVABLE MEMBER AND CONTACT MEMBER, AND SYSTEM USING THE SAME

(71) Applicant: BROTHER KOGYO KABUSHIKI KAISHA, Nagoya-shi, Aichi-ken (JP)

(72) Inventors: Tetsuro Kobayashi, Nagoya (JP); Suguru Tomoguchi, Okazaki (JP); Akihito Ono, Nagoya (JP); Kosuke Nukui, Nagoya (JP); Hiroaki Takahashi, Nagoya (JP); Naoya Okazaki, Gifu-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/277,074

(22) Filed: Sep. 27, 2016

(65) Prior Publication Data

US 2017/0282585 A1 Oct. 5, 2017

(30) Foreign Application Priority Data

Mar. 31, 2016 (JP) ..... 2016-072385

(51) Int. Cl.
*B41J 2/175* (2006.01)

(52) U.S. Cl.
CPC ..... *B41J 2/17566* (2013.01); *B41J 2/175* (2013.01); *B41J 2/17553* (2013.01); *B41J 2002/17586* (2013.01)

(58) Field of Classification Search
CPC .. B41J 2/17543; B41J 2/1755; B41J 2/17566; B41J 2/17553
See application file for complete search history.

(56) References Cited

U.S. PATENT DOCUMENTS 5,136,309 A 8/1992 Iida et al.
5,736,992 A 4/1998 Pawlowski, Jr.
(Continued)

FOREIGN PATENT DOCUMENTS

CN 201645998 U 11/2010
EP 2 371 555 A2 10/2011
(Continued)

OTHER PUBLICATIONS

Extended European Search Report issued in related EP application No. 16190815.7, dated Aug. 22, 2017.
(Continued)

*Primary Examiner* — Sharon A Polk
(74) *Attorney, Agent, or Firm* — Merchant & Gould P.C.

(57) ABSTRACT

A liquid cartridge includes: a cartridge body accommodating a reservoir; a liquid-supply part; a movable member movably supported by the cartridge body; an urging member provided on the movable member; and a contact member provided at a surface of the reservoir. The movable member includes a detected part movable from a first position, to a second position rearward of the first position, and to a third position rearward of the second position, the detected part at the first position and at the second position being positioned higher relative to the cartridge body. The urging member is resiliently deformable, the urging member in a deformed state being deformed to urge the detected part toward the third position. The contact member can contact the movable member, the contact member in contact with the movable member restricting the detected part at the second position from moving to the third position.

19 Claims, 14 Drawing Sheets

(56) References Cited

U.S. PATENT DOCUMENTS

| | | | | |
|---|---|---|---|---|
| 7,424,824 | B2 | 9/2008 | Usui | |
| 8,317,306 | B2 * | 11/2012 | Hattori | B41J 2/17513 347/84 |
| 2009/0289972 | A1 | 11/2009 | Iino | |
| 2011/0249064 | A1 | 10/2011 | Wang et al. | |
| 2011/0292138 | A1 | 12/2011 | Ma | |
| 2011/0310194 | A1 | 12/2011 | Takagi | |
| 2013/0033552 | A1 | 2/2013 | Chen et al. | |
| 2013/0141499 | A1 * | 6/2013 | Tomoguchi | B41J 25/00 347/86 |
| 2014/0098145 | A1 | 4/2014 | Kanbe | |
| 2014/0300671 | A1 | 10/2014 | Nie | |
| 2016/0039215 | A1 * | 2/2016 | Sugahara | B41J 2/17513 347/6 |
| 2017/0282580 | A1 | 10/2017 | Takahashi | |
| 2017/0282583 | A1 | 10/2017 | Okazaki | |
| 2017/0282584 | A1 | 10/2017 | Nuki | |
| 2017/0282585 | A1 | 10/2017 | Kobayashi | |

FOREIGN PATENT DOCUMENTS

| | | | |
|---|---|---|---|
| EP | 2 524 810 | A1 | 11/2012 |
| EP | 2 607 088 | A2 | 6/2013 |
| JP | 3156861 | U | 1/2010 |
| JP | 3157392 | U | 2/2010 |
| WO | 2011050759 | A1 | 5/2011 |

OTHER PUBLICATIONS

"Extended European Search Report issued in related EP application No. 16190843.9, dated Jul. 27, 2017."

Application as filed in related U.S. Appl. No. 15/277,030, filed Sep. 27, 2016.

Application as filed in related U.S. Appl. No. 15/276,958, filed Sep. 27, 2016.

Application as filed in related U.S. Appl. No. 15/276,927, filed Sep. 27, 2016.

Extended European Search Report issued in related EP application No. 16190817.3, dated Sep. 13, 2017.

Extended European Search Report in related European Application No. 16190768.8, dated Nov. 27, 2017.

U.S. Office Action (Notice of Allowance) issued in related U.S. Appl. No. 15/277,030, dated Mar. 28, 2018.

Office Action issued in related U.S. Appl. No. 15/276,958, dated Oct. 20, 2017.

U.S. Office Action (Notice of Allowance) issued in related U.S. Appl. No. 15/276,958, dated Mar. 26, 2018.

Office Action issued in related U.S. Appl. No. 15/277,030, dated Nov. 3, 2017.

Office Action (Notice of Allowance) issued in related U.S. Appl. No. 15/276,927, dated Nov. 3, 2017.

* cited by examiner

LIQUID CARTRIDGE HAVING MOVABLE MEMBER AND CONTACT MEMBER, AND SYSTEM USING THE SAME

CROSS REFERENCE TO RELATED APPLICATION

This application claims priority from Japanese Patent Application No. 2016-072385 filed Mar. 31, 2016. The entire content of the priority application is incorporated herein by reference.

TECHNICAL FIELD

The present disclosure relates to a liquid cartridge attachable to an apparatus such as a printer, and also to a system using the liquid cartridge.

BACKGROUND

There are conventionally known ink cartridges that can be detachably attachable to an apparatus such as a printer. Various detections can be performed out for ink cartridges attached to the apparatus: for example, whether or not an ink cartridge has been attached to a printer; and whether or not a residual amount of ink stored in an ink cartridge is smaller than a predetermined amount. Japanese Utility Model Registration No. 3,157,392 discloses an ink cartridge for which such detections are executed.

SUMMARY

In the above-disclosed ink cartridge, whether or not the ink cartridge has been attached to the printer and whether or not a residual amount of ink stored in the ink cartridge is smaller than a predetermined amount are completely independently detected. Accordingly, this structure results in increase in the number of components required for performing these detections.

Further, in the above-disclosed ink cartridge, a detection mechanism is provided on a front surface of the ink cartridge at which an ink supply port is provided (see FIG. 1). Accordingly, conceivably, when the ink cartridge is removed from the printer, ink adhering to the ink supply port may splash and adhere to the detection mechanism. This adhesion of ink to the detection mechanism may lead to wrong detections in terms of: whether the ink cartridge has been attached to the printer: and whether the amount of ink left in the ink cartridge is smaller than the predetermined amount.

In view of the foregoing, it is an object of the present disclosure to provide a liquid cartridge capable of solving at least the following two problems: increase in the number of components necessary for performing detections; and occurrence of wrong detections.

In order to attain the above and other objects, there is provided a liquid cartridge including a cartridge body, a liquid-supply part, a movable member, an urging member and a contact member. The cartridge body accommodates a reservoir therein, the reservoir being configured to store liquid therein and being deformable. The liquid-supply part is provided on the cartridge body and is configured to allow the liquid stored in the reservoir to flow out therefrom. The movable member is movably supported by the cartridge body and includes a detected part subject to external detection, the detected part being movable from a first position, to a second position rearward of the first position, and to a third position rearward of the second position, the detected part at the first position and at the second position being positioned higher relative to the cartridge body. The urging member is provided on the movable member, the urging member being resiliently deformable and movable between a non-deformed state and a deformed state, the urging member in the deformed state being deformed to generate an urging force to urge the detected part toward the third position. The contact member is provided at a surface of the reservoir and is configured to contact the movable member, the contact member in contact with the movable member restricting the detected part at the second position from moving to the third position.

According to another aspect, there is provided a liquid cartridge including a cartridge body, a liquid-supply part, a movable member and a contact member. The cartridge body accommodates a reservoir therein, the reservoir being configured to store liquid therein and being deformable. The movable member is movably supported by the cartridge body and includes a detected part subject to external detection, the detected part being movable from a detected position to a non-detected position rearward of the detected position. The contact member is provided at a surface of the reservoir and is configured to contact the movable member, the contact member in contact with the movable member restricting the detected part at the detected position from moving to the non-detected position, the detected part at the detected position being positioned higher and exposed upward relative to the cartridge body.

According to still another aspect, there is provided a system including a liquid cartridge and a cartridge-receiving section. The liquid cartridge including a cartridge body, a liquid-supply part, a movable member, an urging member and a contact member. The cartridge body accommodates a reservoir configured to store liquid therein, the reservoir being deformable in accordance with outflow of the liquid from the reservoir. The liquid-supply part is provided on the cartridge body and is configured to allow the liquid stored in the reservoir to flow out therefrom. The movable member is movably supported by the cartridge body and includes a detected part subject to external detection, the detected part being movable from a first position, to a second position rearward of the first position, and to a third position rearward of the second position, the detected part at the first position and at the second position being positioned higher relative to the cartridge body. The urging member is provided on the movable member and is resiliently deformable. The contact member is provided at a surface of the reservoir and is configured to contact the movable member. The liquid cartridge being configured to be inserted into the cartridge-receiving section in a frontward direction, the liquid cartridge being configured to be removed from the cartridge-receiving section in a rearward direction. The cartridge-receiving section includes a first light-emitting part, a second light-emitting part disposed rearward of the first light-emitting part, and an abutting part. The abutting part is configured to abut on the urging member, the urging member being resiliently deformed upon contact against the abutting part to generate an urging force to urge the detected part toward the third position, the detected part at the first position moving to the second position upon receipt of the urging force of the urging member, the contact member in contact with the movable member restricting the detected part at the second position from moving to the third position against the urging force of the urging member, the contact member being configured to move in accordance with deformation of the reservoir to release the contact between the movable member and the contact member and to move the detected part at the second position to the third position due to the urging force of the urging member, the detected part at the first position being configured to block light emitted from the first light-emitting part during insertion of the liquid cartridge into the cartridge-receiving section, the detected part at the second position being configured to block light emitted from the second light-emitting part upon completion of mounting of the liquid cartridge in the cartridge-receiving section.

DETAILED DESCRIPTION

Figure 1:
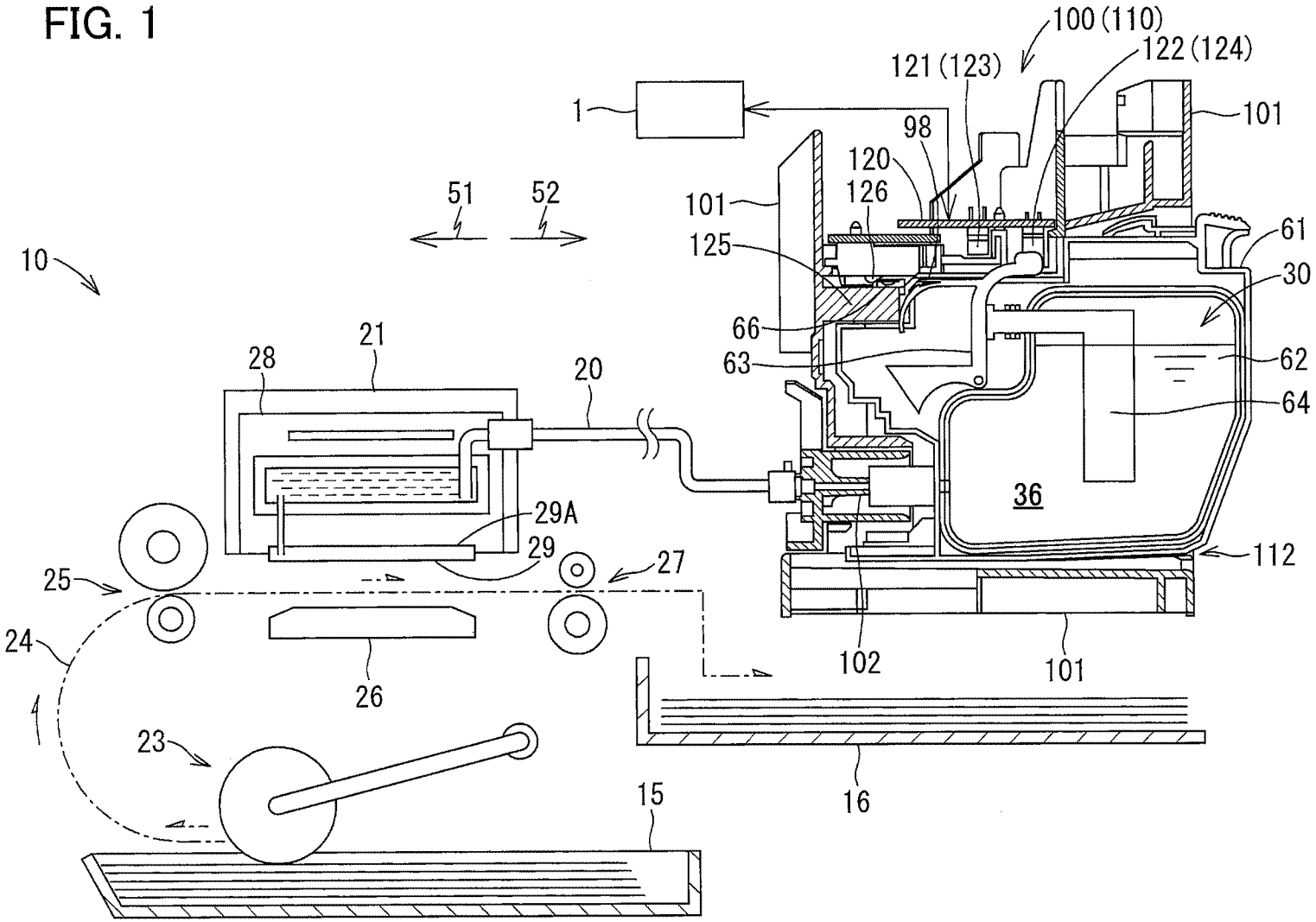
FIG. 1 is a cross-sectional diagram conceptually showing an internal configuration of a printer 10 provided with a cartridge-receiving section 110 that detachably accommodates an ink cartridge 30 according to a first embodiment of the present disclosure.

Hereinafter, while the disclosure is described in detail with reference to the specific embodiments thereof while referring to accompanying drawings, it would be apparent to those skilled in the art that many modifications and variations may be made therein without departing from the scope of the disclosure.

In the following description, a frontward direction 51 is defined as a direction that an ink cartridge 30 according to a first embodiment is inserted into a cartridge-receiving section 110, and a rearward direction 52 is defined as a direction opposite the frontward direction 51, that is, a direction in which the ink cartridge 30 is extracted from the cartridge-receiving section 110. While the frontward direction 51 and rearward direction 52 are horizontal directions in the present embodiment, the frontward direction 51 and rearward direction 52 need not be horizontal directions.

Further, an upward direction 54 is defined as a direction perpendicular to the frontward and rearward directions 51 and 52, and a downward direction 53 is defined as a direction opposite the upward direction 54. While the upward direction 54 is vertically upward and the downward direction 53 is vertically downward in the present embodiment, the upward and downward directions 54 and 53 need not be vertical directions.

Further, a rightward direction 55 and a leftward direction 56 are defined as directions perpendicular to the frontward direction 51 and the downward direction 53. More specifically, when the ink cartridge 30 has been received in the cartridge-receiving section 110, i.e., when the ink cartridge 30 is in an attached posture, and when a user views the ink cartridge 30 in the frontward direction 51, i.e., when the user views the ink cartridge 30 from its rear side, the rightward direction 55 is a direction toward the right and the leftward direction 56 is a direction toward the left. While the rightward and leftward directions 55 and 56 are horizontal directions in the present embodiment, the rightward and leftward directions 55 and 56 need not be horizontal directions.

1. First Embodiment

The ink cartridge 30 according to the first embodiment of the present disclosure will be described while referring to FIGS. 1 through 11.

<Overview of Printer 10>

First, a printer 10 adapted to use the ink cartridge 30 will be described with reference to FIG. 1.

The printer 10 (an example of a system) is configured to form an image by selectively ejecting ink droplets onto a sheet based on an ink jet recording system. As shown in FIG. 1, the printer 10 includes a recording head 21, an ink-supplying device 100, and an ink tube 20 connecting the recording head 21 to the ink-supplying device 100. The ink-supplying device 100 includes the cartridge-receiving section 110 (an example of a cartridge-receiving section). The cartridge-mounting section 110 can detachably receive the ink cartridge 30 (an example of a liquid cartridge) therein.

Specifically, the cartridge-receiving section 110 has one side formed with an opening 112. The ink cartridge 30 can be inserted into the cartridge-mounting section 110 in the frontward direction 51 through the opening 112, and extracted from the cartridge-receiving section 110 in the rearward direction 52 through the opening 112.

The ink cartridge 30 stores ink therein that the printer 10 can use for printing. The ink cartridge 30 is connected to the recording head 21 through the ink tube 20 when the ink cartridge 30 has been completely mounted in the cartridge-receiving section 110.

In the printer 10 of the present embodiment, the cartridge-receiving section 110 can accommodate therein four kinds of ink cartridges 30 corresponding to four colors of cyan, magenta, yellow and black, respectively. However, for simplifying explanation, only one ink cartridge 30 is assumed to be mounted in the cartridge-receiving section 110 in FIG. 1 and explanations therefor.

The recording head 21 has a sub tank 28 for temporarily storing ink supplied from the ink cartridge 30 through the ink tube 20. The recording head 21 also includes a plurality of nozzles 29 through which the ink supplied from the sub tank 28 is selectively ejected in accordance with the ink jet recording system. More specifically, the recording head 21 includes a head control board (not shown), and piezoelectric elements 29A corresponding one-on-one to the nozzles 29. The head control board is configured to selectively apply drive voltages to the piezoelectric elements 29A in order to eject ink selectively from the nozzles 29.

The printer 10 also includes a sheet tray 15, a sheet feeding roller 23, a conveying path 24, a pair of conveying rollers 25, a platen 26, a pair of discharge rollers 27, and a sheet discharge tray 16. The sheet feeding roller 23 is configured to feed sheets of paper from the sheet tray 15 onto the conveying path 24, and the conveying rollers 25 are configured to convey the sheets over the platen 26. The recording head 21 is configured to selectively eject ink onto the sheets as the sheets move over the platen 26, whereby images are recorded on the sheets. That is, the ink stored in the ink cartridge 30 that has been completely mounted in the cartridge-mounting section 110 can be consumed by the recording head 21. The discharge rollers 27 are adapted to receive the sheets that have passed over the platen 26 and are configured to discharge the sheets onto the sheet discharge tray 16 disposed on a downstream end of the conveying path 24.

<Ink-Supplying Device 100>

The ink-supplying device 100 is provided in the printer 10, as shown in FIG. 1. The ink-supplying device 100 functions to supply ink to the recording head 21. As described above, the ink-supplying device 100 includes the cartridge-receiving section 110 for detachably receiving the ink cartridge 30. FIG. 1 shows a state where the ink cartridge 30 has been completely received in the cartridge-receiving section 110.

<Cartridge-Receiving Section 110>

Figure 2:
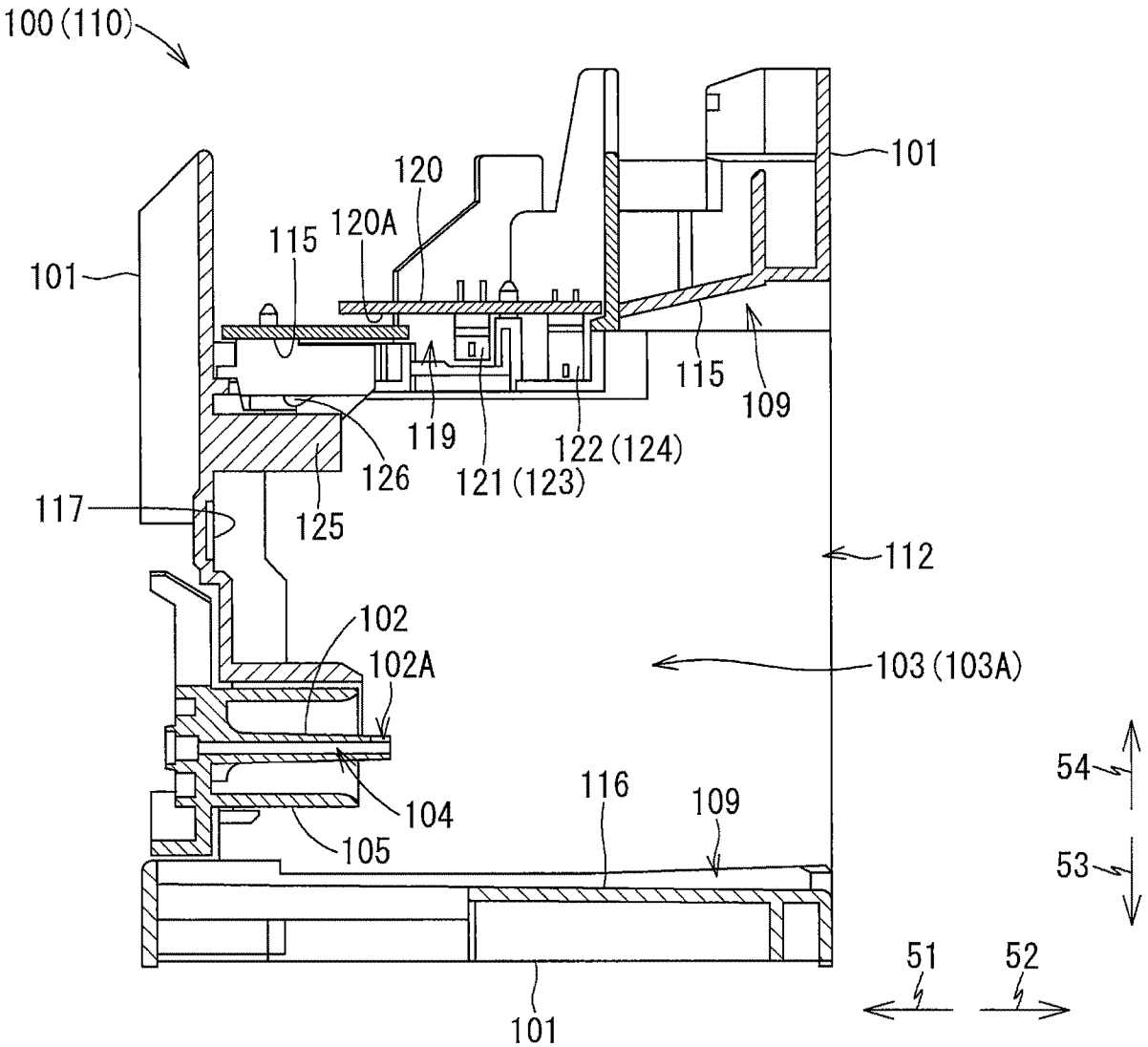
FIG. 2 is a vertical cross-sectional view showing an internal configuration of the cartridge-receiving section 110.

The cartridge-receiving section 110 includes a case 101, and four sets of an ink needle 102, a substrate 120, a first sensor 121, a second sensor 122, and an abutting part 125 (see FIG. 2). The cartridge-receiving section 110 also includes a plurality of contacts 126 only one of which is illustrated in FIG. 2.

The case 101 has a box-like shape and defines an internal space 103 therein (see FIG. 2). The internal space 103 is partitioned into four individual spaces 103A arranged in the rightward direction 55 and leftward direction 56. In each of these four spaces 103A, the four kinds of ink cartridges 30 corresponding to four colors of cyan, magenta, yellow and black can be received, respectively. Each internal space 103A is an example of a cartridge accommodation space.

Each of the four ink needles 102, four substrates 120, four first sensors 121, four second sensors 122 and four abutting parts 125 are provided corresponding to each of the ink cartridges 30. That is, the four ink needles 102, four substrates 120, four first sensors 121, four second sensors 122 and four abutting parts 125 are provided respectively to be aligned with one another in the rightward direction 55 and leftward direction 56. Further, the four ink needles 102, four substrates 120, four first sensors 121, four second sensors 122 and four abutting parts 125 have the same configurations as one another, respectively. Hence, hereinafter, for simplifying explanation, only one each of the four ink needles 102, four substrates 120, four first sensors 121, four second sensors 122 and four abutting parts 125 will be described, while descriptions for remaining three each thereof will be omitted.

<Case 101>

The case 101 defines an outer shape of the cartridge-receiving section 110. Specifically, the case 101 includes a top wall 115, a bottom wall 116, and an end wall 117 connecting the top wall 115 and the bottom wall 116. The case 101 is formed with the opening 112. Specifically, the top wall 115 and the bottom wall 116 define a ceiling and a bottom of the internal space 103 of the case 101, respectively. The end wall 117 defines an end of the internal space 103 of the case 101 in the frontward direction 51. That is, the opening 112 is arranged to face the end wall 117 in the rearward direction 52. The opening 112 can be exposed to a surface (user-interface surface) that a user can face when using the printer 10.

As show in FIG. 2, the top wall 115 is formed with four upper guide grooves 109 aligned with each other in the rightward and leftward directions 55 and 56, while the bottom wall 116 is formed with four lower guide grooves 109 aligned with each other in the rightward and leftward directions 55 and 56. When the ink cartridge 30 is inserted into and removed from the case 101 through the opening 112, upper and lower portions of the ink cartridge 30 are respectively guided by the corresponding upper and lower guide grooves 109 in the frontward direction 51 and rearward direction 52. The case 101 further includes three partitioning plates (not shown) partitioning the internal space 103 of the case 101 into the four individual spaces 103A elongated in the downward direction 53 and upward direction 54. The ink cartridge 30 can be detachably accommodated in the corresponding space 103A defined in the case 101.

The opening 112 of the case 101 can be opened and closed by a cover (not illustrated). This cover is attached to a pivot shaft (not illustrated) that extends in the rightward direction 55 and leftward direction 56 and is arranged in the vicinity of a lower end of the opening 112. With this configuration, the cover is pivotally movable about an axis of the pivot shaft between a closing position closing the opening 112 and an opening position opening the opening 11. When the cover is in the opening position, the user can insert/remove the ink cartridge 30 into/from the case 101 through the opening 112. When the cover is in the closing position, the user cannot insert and remove the ink cartridge 30 into/from the case 101; and the user cannot have access to the ink cartridge 30 accommodated in the case 101.

In the vicinity of an upper end of the opening 112 of the case 101, a cover sensor 118 (see FIG. 9) is provided. The cover sensor 118 can detect whether or not the cover sensor 118 is in abutment with the not-illustrated cover. When the cover is at the closing position, the cover sensor 118 is in contact with an upper end portion of the cover, and the cover sensor 118 thus outputs a detection signal to a controller 1. When the cover is not located at the closing position, the cover sensor 118 does not output the detection signal.

<Ink Needle 102>

As shown in FIG. 2, the ink needle 102 is disposed on a lower end portion of the end wall 117 of the case 101. The ink needle 102 is formed of resin and has a generally tubular shape. Specifically, the ink needle 102 is disposed at the end wall 117 at a position corresponding to an ink supply part 34 (described later) of the ink cartridge 30 mounted in the cartridge-receiving section 110. The ink needle 102 extends (protrudes) in the rearward direction 52 from the end wall 117.

A cylindrical-shaped guide part 105 is provided to surround the ink needle 102. The guide part 105 protrudes in the rearward direction 52 from the end wall 117 and has an open protruding end. Specifically, the ink needle 102 is positioned at a center of the guide part 105. The guide part 105 is thus formed to allow the ink supply part 34 of the ink cartridge 30 to be received in the guide part 105.

During insertion of the ink cartridge 30 into the cartridge-receiving section 110 in the frontward direction 51, i.e., in the course of action of the ink cartridge 30 moving to a mounted position received in the cartridge-receiving section 110, the ink supply part 34 of the ink cartridge 30 enters into the corresponding guide part 105. As the ink cartridge 30 is inserted further in the frontward direction 51, the ink needle 102 enters into an ink supply port 71 (see FIG. 3) of the ink supply part 34, thereby connecting the ink needle 102 and the ink supply part 34. Hence, the ink stored in an ink chamber 36 (see FIG. 3) formed in the ink cartridge 30 can flow into the ink tube 20 connected to the ink needle 102 through an internal space (not shown) of the ink supply part 34 and an internal space 104 formed in the ink needle 102. The ink needle 102 may have a flat-shaped tip end or a pointed tip end.

<Substrate 120, First Sensor 121, and Second Sensor 122>

As illustrated in FIG. 2, the substrate 120 is arranged near the top wall 115 of the case 101. An opening 119 is formed in a center portion of the top wall 115 in the frontward direction 51 and rearward direction 52. The substrate 120 has a lower surface 120A that is exposed to the internal space 103 of the case 101 through the opening 119. The substrate 120 is made of a glass-epoxy, for example.

The first and second sensors 121 and 122 are mounted on the lower surface 120A of the substrate 120. The first sensor 121 (an example of a first optical sensor) is disposed further in the forward direction 51 (i.e., frontward) relative to the second sensor 122. The second sensor 122 is an example of a second optical sensor and an example of an optical sensor.

The first sensor 121 includes a light-emitting part 123 and a light-receiving part (not shown). The light-emitting part 123 and light-receiving part are arranged to face each other in the rightward direction 55 and leftward direction 56. The light-emitting part 123 is disposed at a right end portion defining corresponding one of the four spaces 103A in the internal space 103. The light-receiving part is disposed at a left end portion defining corresponding one of the four spaces 103A in the internal space 103. The right and left positions of the respective light-emitting part 123 and light-receiving part may be arranged in reverse.

The second sensor 122 includes a light-emitting part 124 and a light-receiving part (not shown). The light-emitting part 124 and light-receiving part are arranged to face each other in the rightward direction 55 and leftward direction 56. The light-emitting part 124 is disposed at the right end portion defining the corresponding one of the four spaces 103A in the internal space 103. The light-receiving part is disposed at the left end portion defining the corresponding one of the four spaces 103A in the internal space 103. The right and left positions of the respective light-emitting part 124 and light-receiving part may be arranged in reverse.

The first and second sensors 121 and 122 are electrically connected to the controller 1 (see FIGS. 1 and 9) of the printer 10 through electric circuits. Details of the controller 1 will be described later.

<Abutting Part 125>

As illustrated in FIG. 2, the abutting part 125 is provided on the end wall 117 at a position near the top wall 115. The abutting part 125 is an example of a protruding part and an example of an abutting part. The abutting part 125 protrudes in the rearward direction 52 from the end surface 117 of the case 101. The abutting part 125 can abut against a leaf spring 135 constituting a movable member 63 (see FIG. 3) of the ink cartridge 30 during insertion of the ink cartridge 30 into the cartridge-receiving section 110.

<Contact 126>

As illustrated in FIG. 2, a plurality of contacts 126 is provided on the top surface 115 of the case 101 at a position above the abutting part 125. The contacts 126 can be electrically connected to electrodes 67 (see FIG. 3) of an IC board 66 of the ink cartridge 30 attached to the cartridge-receiving section 110. The number and arrangement of the contacts 126 are determined to correspond to the number and arrangement of the electrodes 67. The controller 1 (described later) can be thus electrically connected to the IC board 66 through the contacts 126.

<Ink Cartridge 30>

The ink cartridge 30 is configured to be inserted into and mounted in the cartridge-receiving section 110 in the frontward direction 51. The ink cartridge 30 is also configured to be removed from the cartridge-receiving section 110 in the rearward direction 52. The frontward direction 51 and the rearward direction 52 are horizontal in the present embodiment.

Figure 3:
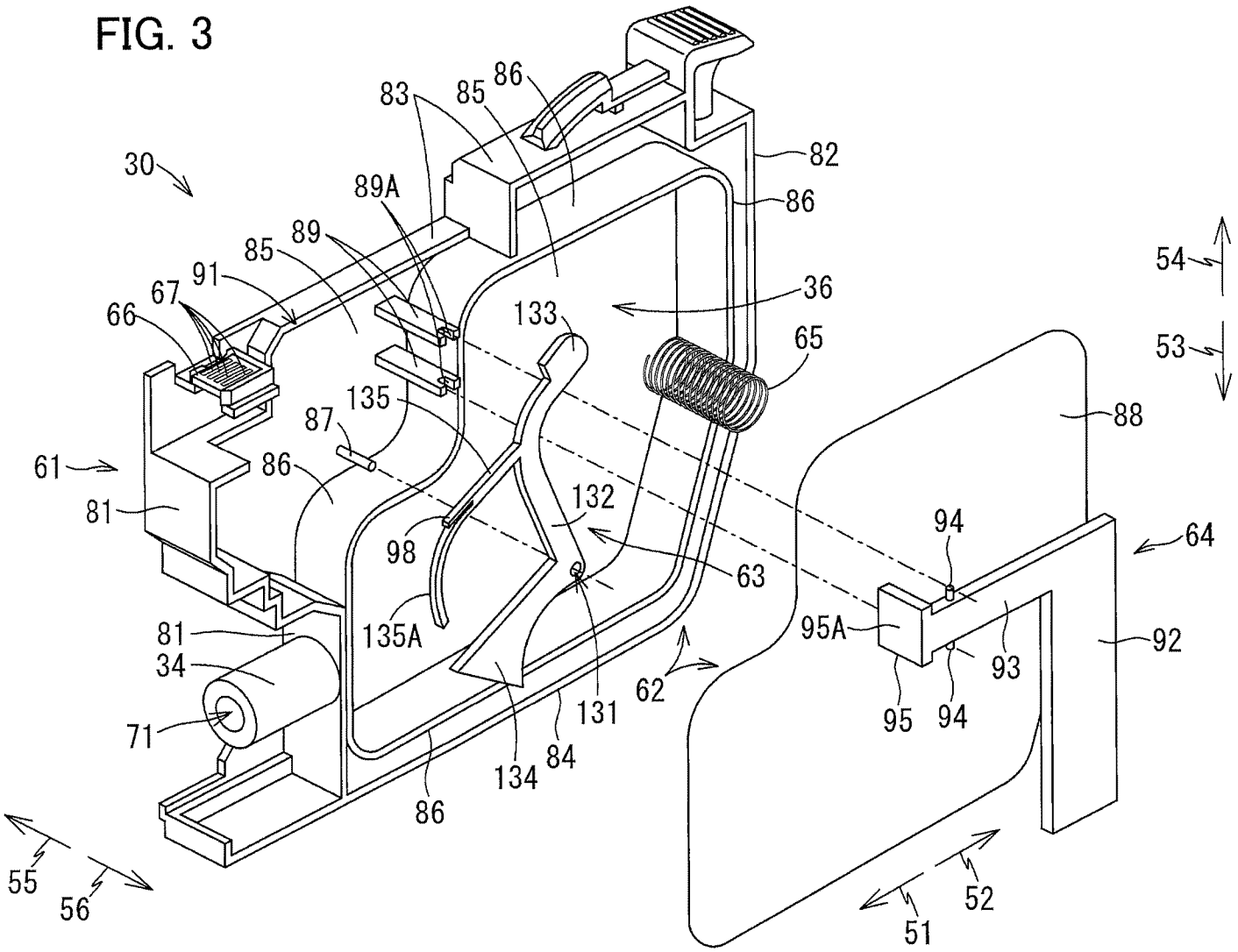
FIG. 3 is an exploded perspective view of the ink cartridge 30 according to the first embodiment.
Figure 4:
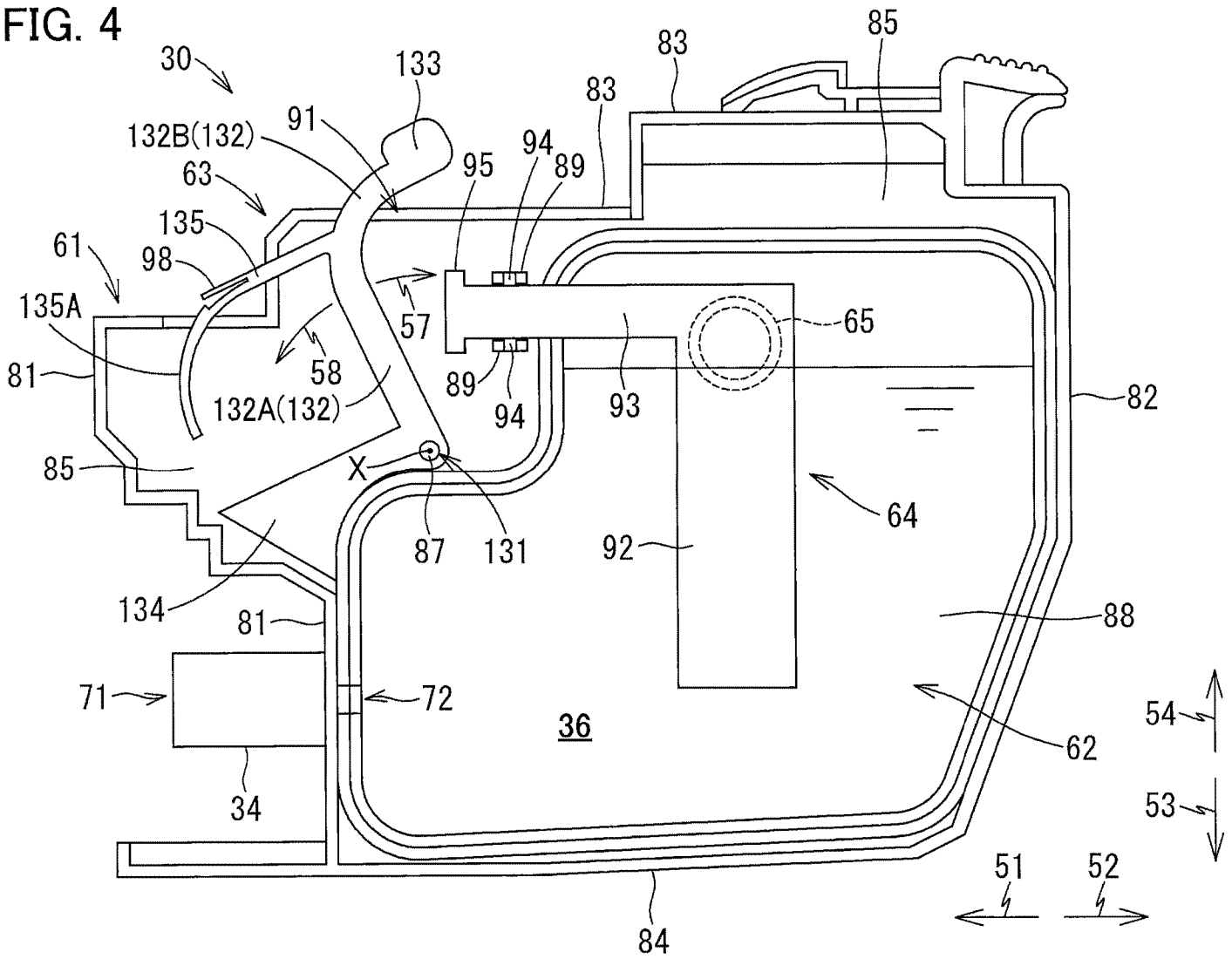
FIG. 4 is a left side view of the ink cartridge 30 of the first embodiment.

The ink cartridge 30 is a container configured to store ink therein. As shown in FIGS. 3 and 4, the ink cartridge 30 includes a cartridge body 61, the movable member 63, a contact member 64, and a coil spring 65.

<Cartridge Body 61>

The cartridge body 61 shown in FIGS. 3 and 4 constitutes an outer shape of the ink cartridge 30. The cartridge body 61 is in the orientation shown in FIGS. 3 and 4 when the ink cartridge 30 is attached to the cartridge-receiving section 110 (in the attached posture). In the attached posture of the ink cartridge 30, the cartridge body 61 has a generally flat shape having a height in the downward direction 53 and upward direction 54, a width in the rightward direction 55 and leftward direction 56, and a length in the frontward direction 51 and rearward direction 52, the width being smaller than the height and the length, as shown in FIGS. 3 and 4. That is, the cartridge body 61 has the length in the frontward direction 51 and rearward direction 52 that is horizontal in the attached posture of the ink cartridge 30.

The cartridge body 61 includes a front wall 81, a rear wall 82, an upper wall 83, a lower wall 84, and a pair of side walls 85. In the drawings, only one of the side walls 85 is illustrated. The front wall 81 (an example of a front wall) faces in the frontward direction 51. That is, the front wall 81 is a wall configured to oppose the end wall 117 of the cartridge-receiving section 110 in the frontward direction 51 when the ink cartridge 30 has been attached to the cartridge-receiving section 110 (in the attached posture). The rear wall 82 (an example of a rear wall) is arranged further in the rearward direction 52 (i.e., rearward) relative to the front wall 81 to oppose the front wall 81 in the frontward direction 51 and rearward direction 52. The upper wall 83 (an example of an upper wall) connects upper end portions of the front wall 81, the rear wall 82, and the side walls 85. The lower wall 84 connects lower end portions of the front wall 81, the rear wall 82, and the side walls 85. The side wall 85 shown in FIG. 3 constitutes a right surface of the cartridge body 61 (right side wall 85). The other side wall 85 not shown in the drawings is arranged to oppose the side wall 85 show in FIG. 3 and constitutes a left surface of the cartridge body 61 (left side wall 85). The front wall 81, rear wall 82, upper wall 83, lower wall 84, and both side walls 85 define an internal space of the ink cartridge 30.

In the attached posture, the upper wall 83 extends horizontally. The upper wall 83 has a stepped structure. More specifically, due to a step formed on the upper wall 83, a rearward portion of the upper wall 83 (a portion arranged rearward of the step) is formed to be higher than a frontward portion of the upper wall 83 (a portion arranged frontward of the step). The rearward portion of the upper wall 83 connects the side walls 85.

A through-hole 91 is formed in the frontward portion of the upper wall 83 to penetrate the same in the upward direction 54 and downward direction 53. Specifically, a recess is formed in the frontward portion of the upper wall 83. This recess is recessed in the rightward direction 55 from a left end of the frontward portion of the upper wall 83. In the present embodiment, the through-hole 91 is defined by forming the recess in the frontward portion of the upper wall 83. In other words, the through-hole 91 is defined by the frontward portion of the upper wall 83 and the left side wall 85 (not shown). The through-hole 91 is formed to extend in the frontward direction 51 and rearward direction 52. Specifically, the through-hole 91 has a front-rear dimension that is longer than a movable range of an extending part 132 (described later) of the movable member 63 in the frontward direction 51 and rearward direction 52. As will be described later, the extending part 132 of the movable member 63 extends upward to penetrate the through-hole 91 from below and protrudes upward in the upward direction 54 beyond the upper wall 83 through the through-hole 91 (see FIG. 4).

A shaft bar 87 and a pair of protruding parts 89 are formed on an upper-front portion of the right side wall 85. Specifically, the shaft bar 87 extends in the leftward direction 56 from a left surface of the upper-front portion of the right side wall 85. The shaft bar 87 is inserted into a shaft hole 131 formed in the movable member 63, as will be described later. The protruding parts 89 extend in the leftward direction 56 from the left surface of the upper-front portion of the right side wall 85. The protruding parts 89 are arranged to be spaced apart from each other in the upward direction 54 and downward direction 53. Each of the protruding parts 89 has a protruding end in which a concave part 89A is formed. The concave parts 89A are aligned with each other in the upward direction 54 and downward direction 53. A pair of projections 94 of the contact member 64 is fitted into the respective concave parts 89A so that the protruding parts 89 can pivotably movably support the contact member 64.

On the upper wall 83 of the cartridge body 61, the IC board 66 is also disposed. The IC board 66 is arranged further in the frontward direction 51 (i.e., frontward) relative to the movable member 63. Four electrodes 67 are provided on an upper surface of the IC board 66. The electrodes 67 extend in the frontward direction 51 and rearward direction 52 and are arranged in separation from one another in the rightward direction 55 and leftward direction 56. The electrodes 67 are, for example, a HOT electrode, a GND electrode, and a signal electrode. The IC board 66 also includes an IC (not illustrated) that is electrically connected to the respective electrodes 67. The IC is a semiconductor integrated circuit, and stores therein data indicative of a type of the ink cartridge 30, such as a lot number and a manufactured date, for example. The data stored in the IC is retrievable from outside. Specifically, when the ink cartridge 30 is attached to the cartridge-receiving section 110, the IC is electrically connected to the controller 1 of the printer 10 through the electrodes 67. In this state, the controller 1 (see FIGS. 1 and 9) can retrieve the data stored in the IC board 66, and specify the type of the attached ink cartridge 30 based on the data read out from the IC board 66.

Further, a reservoir 62 is accommodated in the cartridge body 61 as an example of a reservoir. The reservoir 62 is configured of a peripheral wall 86, a film 88 and the right side wall 85. The peripheral wall 86 has a generally endless shape in a side view. The peripheral wall 86 protrudes in the leftward direction 56 from the right side wall 85. The film 88 is welded to a protruding end (left end) of the peripheral wall 86 and constitutes a left end of the reservoir 62. That is, the film 88 covers a surface of the reservoir 62 facing in the leftward direction 56. A space enclosed by the peripheral wall 86, the film 88, and right side wall 85 serves as the ink chamber 36. Put another way, the peripheral wall 86 defines upper, lower, front, and rear surfaces of the ink chamber 36, while the right side wall 85 and the film 88 respectively define right and left surfaces of the ink chamber 36. Ink is stored in the ink chamber 36 (an example of a liquid chamber).

When pressure inside the ink chamber 36 becomes lower than the pressure outside thereof in accordance with outflow of ink in the ink chamber 36, the film 88 deforms in the rightward direction 55 such that a volume of the ink chamber 36 is reduced. That is, the reservoir 62 has flexibility.

While the reservoir 62 of the first embodiment is configured of the peripheral wall 86, film 88 and right side wall 85, the reservoir 62 may be formed as a resin bag, for example. Still alternatively, the reservoir 62 may be formed separately from the cartridge body 61 configured of the front wall 81, rear wall 82, upper wall 83, lower wall 84 and side walls 85. That is, the ink cartridge 30 may include: an inner case having a reservoir surrounded by the peripheral wall 86; and an outer case configured of the front wall 81, rear wall 82, upper wall 83, lower wall 84, and the side walls 85. In this case, the movable member 63 may be supported either by the inner case or the outer case.

Incidentally, the front surface, rear surface, upper surface, lower surface, and side surfaces of the ink cartridge 30 need not be configured as one plane, respectively. That is, the front surface of the ink cartridge 30 can be any surface(s) that can be seen when the ink cartridge 30 is viewed in the rearward direction 52; and that is (are) positioned frontward relative to a front-rear center of the ink cartridge 30. The rear surface of the ink cartridge 30 can be any surface(s) that can be seen when the ink cartridge 30 is viewed in the forward direction 51; and that is(are) positioned rearward relative to the front-rear center of the ink cartridge 30. The upper surface of the ink cartridge 30 can be any surface(s) that can be seen when the ink cartridge 30 is viewed in the downward direction 53; and that is(are) positioned upward relative to a center of the ink cartridge 30 in the upward direction 54 and downward direction 53. The lower surface of the ink cartridge 30 can be any surface(s) that can be seen when the ink cartridge 30 is viewed in the upward direction 54; and that is positioned downward relative to the center of the ink cartridge 30 in the upward direction 54 and downward direction 53. The same is applied to the side surfaces. That is, while the rearward portion of the upper wall 83 that is positioned rearward of the step is disposed higher than the frontward portion of the upper wall 83 in the present embodiment, the upper wall 83 may be configured to have no level difference in the upward direction 54 and downward direction 53.

The ink supply part 34 (an example of a liquid-supply part) is provided on a lower portion of the front wall 81 and protrudes in the forward direction 51 therefrom. The ink supply part 34 has a generally cylindrical shape and has an inner space defined therein. The ink supply part 34 has a front end (protruding end) in which an ink supply port 71 is formed. The ink supply port 71 provides communication between the inner space of the ink supply part 34 and outside of the ink cartridge 30. The ink supply part 34 has a base end (rear end) formed with an opening 72 (see FIG. 4). The opening 72 provides communication between the inner space of the ink supply part 34 and the ink chamber 36.

Within the inner space of the ink supply part 34, a valve (not shown) is disposed. As a default state, the valve is in a closed state to prevent the ink in the ink chamber 36 from flowing out of the ink cartridge 30. However, during insertion of the ink cartridge 30 into the cartridge-receiving section 110 in the forward direction 51, the valve is pushed by the ink needle 102 being inserted into the inner space of the ink supply part 34 through the ink supply port 71, thereby turning the valve into an open state. When the valve is opened, the ink stored in the ink chamber 36 can flow into the ink tube 20 connected to the ink needle 102 through the inner space of the ink supply part 34 and the internal space 104 of the ink needle 102.

Note that the ink needle 102 has a side surface formed with an opening 102A, as shown in FIG. 2. Through this opening 102A, the ink in the inner space of the ink supply part 34 can enter into the internal space 104 of the ink needle 102.

The ink supply part 34 is not limited to the depicted configuration having the valve. Instead, for example, the ink supply port 71 may be closed by a film or the like. In this case, the ink needle 102 may break through the film at the time of insertion of the ink cartridge 30 into the cartridge-receiving section 110, thereby allowing a tip end of the ink needle 102 to enter into the inner space of the ink supply part 34 through the ink supply port 71.

<Movable Member 63>

The movable member 63 is movably supported by the cartridge body 61. Specifically, as illustrated in FIGS. 3 and 4, the movable member 63 is provided such that a major portion thereof, except an upper end portion thereof (an upper end portion 132B of the extending part 132), is accommodated inside the cartridge body 61. The major portion of the movable member 63 (a lower end portion 132A of the extending part 132) is disposed in a space within the cartridge body 61 in which the reservoir 62 is not present, i.e., at a position upward and frontward of the reservoir 62 within the cartridge body 61.

More specifically, the shaft hole 131 formed in the movable member 63 receives the shaft bar 87 of the cartridge body 61. The shaft bar 87 is inserted into the shaft hole 131 to penetrate the movable member 63 through the shaft hole 131. With this configuration, the movable member 63 is supported by the cartridge body 61 such that the movable member 63 can pivot about a center of the shaft hole 131 (i.e., axis X of the shaft bar 87, see FIG. 4) in a direction indicated by an arrow 57 (direction 57) as well as in a direction indicated by an arrow 58 (direction 58) in FIG. 4. This axis X of the shaft bar 87 is an example of a pivot shaft.

The movable member 63 includes the extending part 132, a detected part 133 subject to external detection, a weight part 134 (an example of another urging member), and the leaf spring 135 (an example of an urging member). In the present embodiment, the movable member 63 is integrally molded by resin, but the movable member 63 need not be integrally molded. For example, the extending part 132 and detected part 133 may be connected by means of fitting one to the other. In the following description of the movable member 63, directions are defined assuming that the movable member 63 is in a state illustrated in FIG. 4.

The extending part 132 generally extends in the upward direction 54 and downward direction 53. The shaft hole 131 is formed in the lower end portion 132A of the extending part 132. The shaft hole 131 is a through-hole extending in the rightward direction 55 and leftward direction 56. The lower end portion 132A of the extending part 132 is located below the upper wall 83 constituting the cartridge body 61 in the downward direction 53. The extending part 132 extends upward in the upward direction 54 from the lower end portion 132A and penetrates the through-hole 91 formed in the upper wall 83 from below. The extending part 132 has the upper end portion 132B that is curved toward the rear in the rearward direction 52 as extending upward in the upward direction 54. The upper end portion 132B of the extending part 132 protrudes upward in the upward direction 54 relative to the upper wall 83. That is, the upper end portion 132B of the extending part 132 is located above the upper wall 83. The lower end portion 132A of the extending part 132 is an example of an accommodated portion, while the upper end portion 132B of the extending part 132 is an example of a protruding portion.

The detected part 133 is provided on the upper end portion 132B of the extending part 132. That is, the detected part 133 is disposed further in the upward direction 54 (i.e., upward) relative to the cartridge body 61. In other words, the detected part 133 protrudes in the upward direction 54 relative to the cartridge body 61. More in detail, the detected part 133 is positioned above the upper wall 83 and higher than the IC board 66 in the upward direction 54. The detected part 133 has a plate-like shape extending in the frontward direction 51 and rearward direction 52 as well as in the upward direction 54 and downward direction 53. The detected part 133 is exposed upward so as to allow external and physical access thereto. Alternatively, the detected part 133 may be covered by a translucent cover, for example.

The detected part 133 can move in accordance with pivotal movement of the movable member 63. More specifically, the detected part 133 is movable from a first position illustrated in FIG. 5, to a second position illustrated in FIG. 6, and to a third position illustrated in FIG. 7. The detected part 133 at the second position is located further in the downward direction 53 and further in the rearward direction 52 (i.e., downward and rearward) relative to the detected part 133 at the first position. The detected part 133 at the third position is located further in the downward direction 53 and further in the rearward direction 52 (i.e., downward and rearward) relative to the detected part 133 at the second position. The first position is an example of a first position and an example of an initial position. The second position is an example of a second position and an example of a detected position. The third position is an example of a third position and an example of a non-detected position.

Figure 5:
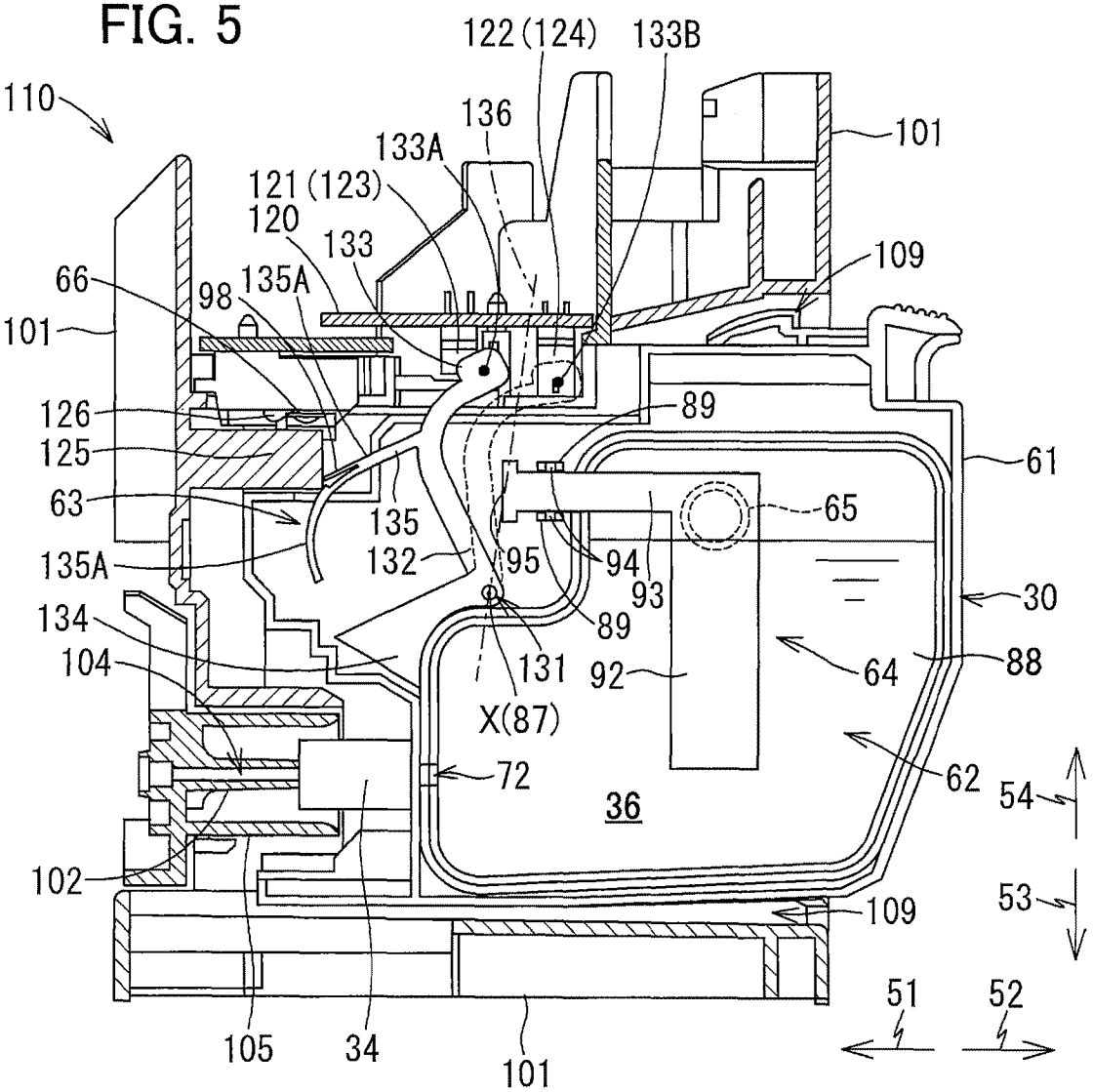
FIG. 5 is a vertical cross-sectional view showing the ink cartridge 30 of the first embodiment and the cartridge-receiving section 110, wherein a detected part 133 is at a first position.

The detected part 133 is a part that is configured to be detected by the first sensor 121 of the cartridge-receiving section 110 during insertion of the ink cartridge 30 into the cartridge-receiving section 110, and that is configured to be detected by the second sensor 122 of the cartridge-receiving section 110 when the ink cartridge 30 is attached to the cartridge-receiving section 110. As illustrated in FIG. 5, the detected part 133 at the first position is located higher relative to the upper wall 83 of the cartridge body 61, and is located between the light-emitting part 123 and light-receiving part of the first sensor 121. Accordingly, the detected part 133 at the first position can block light emitted from the light-emitting part 123. In this state, the movable member 63 is separated from the contact member 64 to be described later. Also, when the detected part 94 is at the first position, the leaf spring 96 contacts the abutting part 125.

Figure 6:
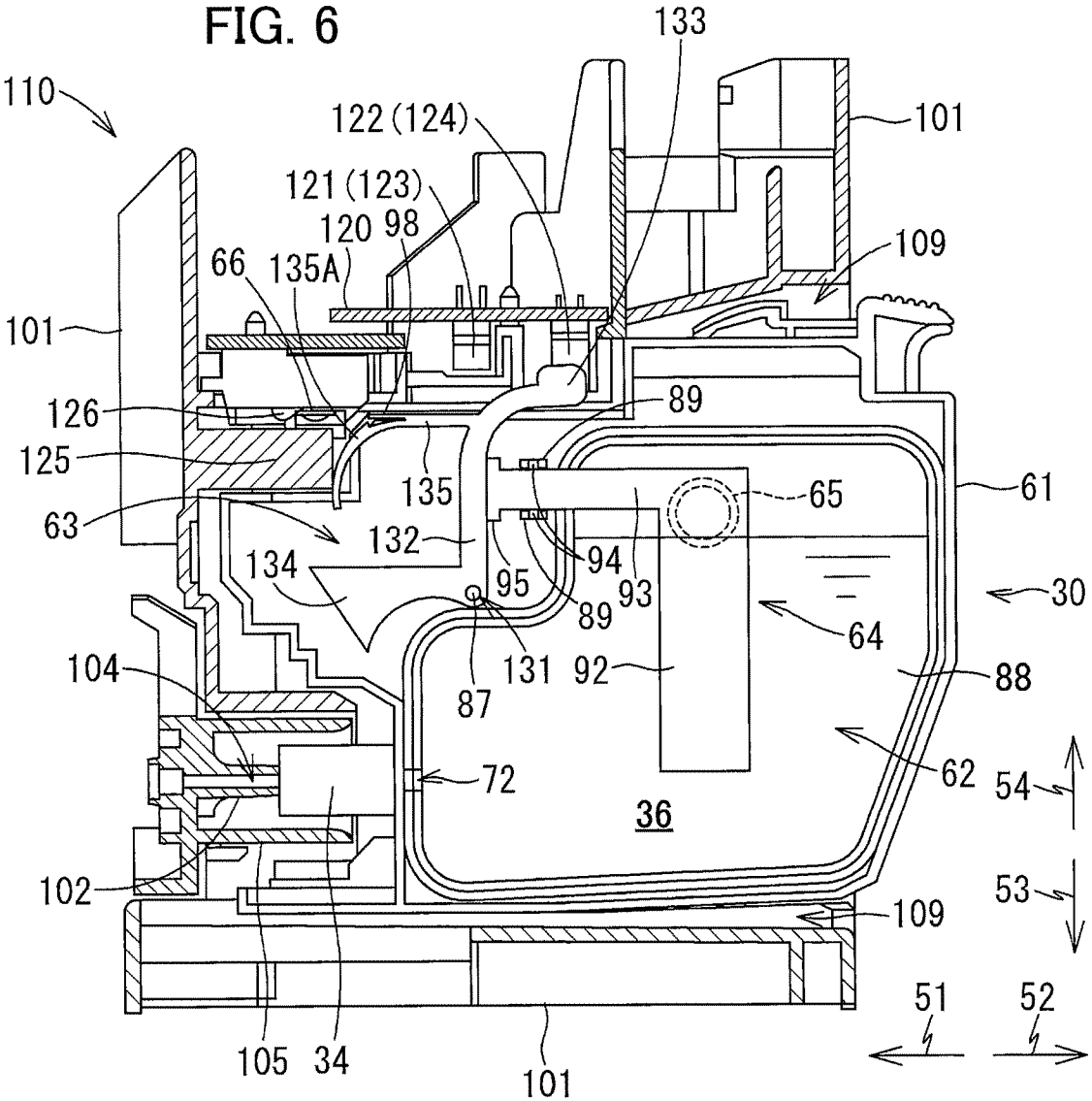
FIG. 6 is a vertical cross-sectional view showing the ink cartridge 30 of the first embodiment and the cartridge-receiving section 110, wherein the detected part 133 is at a second position.

As illustrated in FIG. 6, the detected part 133 at the second position is still positioned higher relative to the upper wall 83 of the cartridge body 61 and is now located between the light-emitting part 124 and light-receiving part of the second sensor 122. Accordingly, the detected part 133 at the second position can block light emitted from the light-emitting part 124.

Figure 7:
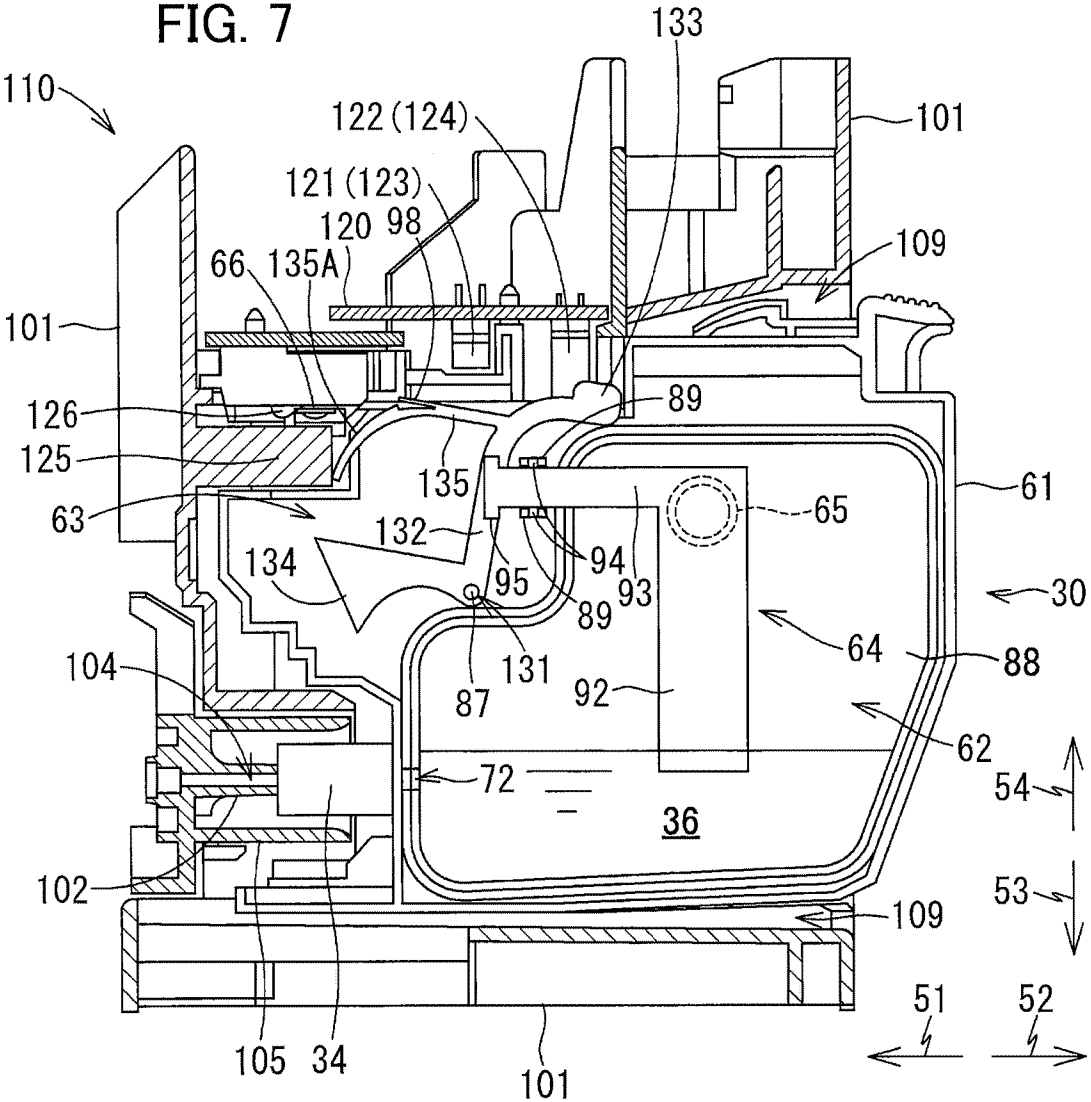
FIG. 7 is a vertical cross-sectional view showing the ink cartridge 30 of the first embodiment and the cartridge-receiving section 110, wherein the detected part 133 is at a third position.

As illustrated in FIG. 7, the detected part 133 at the third position is neither located between the light-emitting part 123 and light-receiving part of the first sensor 121, nor between the light-emitting part 124 and light-receiving part of the second sensor 122. Thus, the detected part 133 at the third position neither blocks the light emitted from the light-emitting part 123 nor the light emitted from the light-emitting part 124.

Specifically, in the present embodiment, the light emitted from the respective light-emitting parts 123 and 124 of the first and second sensors 121 and 122 is incident on a right surface of the detected part 133, is outputted from a left surface of the detected part 133, and then reaches the corresponding light-receiving parts of the first sensor 121 and the second sensor 122. When the detected part 133 blocks the light, intensity of light received at the corresponding light-receiving parts (light transmission state of the detected part 133) becomes less than a predetermined intensity, for example, zero. The detected part 133 may completely block the light traveling in the rightward direction 55 or leftward direction 56, or may partially absorb the light, may refract the light to change its traveling direction, or may fully reflect the light.

Here, referring to FIG. 5, assume that the detected part 133 at the first position defines a center 133A (an example of a first center), the detected part 133 at the second position defines a center 133B (an example of a second center), and a dashed line 136 represents a perpendicular bisector of a line segment connecting between the center 133A and the center 133B. As show in FIG. 6, the center of the shaft hole 131, i.e., the axis X of the shaft bar 87 (pivot axis of the movable member 63) is positioned on the perpendicular bisector 136.

As illustrated in FIGS. 3 and 4, the weight part 134 extends in the frontward direction 51 from the lower end portion of the extending part 132. That is, the weight part 134 is positioned further in the frontward direction 51 (i.e., frontward) relative to the shaft hole 131. Due to the weight of the weight part 134, the movable member 63 is urged in the direction 58 (i.e., counterclockwise) in FIG. 4. In other words, the detected part 133 is urged toward the first position by the weight of the weight part 134. Although the detected part 133 is urged toward the first position by the weight part 134 in the present embodiment, the weight part 134 may be dispensed with, provided that the detected part 133 can be urged toward the first position due to the position of the gravity center of the movable member 63 itself.

The leaf spring 135 protrudes in the frontward direction 51 from an intermediate portion of the extending part 132 between the lower and upper end portions of the extending part 132. That is, the leaf spring 135 has a base end portion connected to the intermediate portion of the extending part 132. The leaf spring 135 is positioned further in the upward direction 54 and further in the frontward direction 51 (i.e., upward and frontward) relative to the shaft hole 131. Further, the leaf spring 135 is provided with a contact part 98. The contact part 98 extends forward from the base end portion of the leaf spring 135. The contact part 98 has a leading end that is positioned above and rearward of a front end portion of the leaf spring 135.

In the present embodiment, the contact part 98 and part of the leaf spring 135 can abut against the abutting part 125 of the cartridge-receiving section 110. In other words, in the present embodiment, the leaf spring 135 extends frontward and downward and is curved such that the leaf spring 135 is resiliently deformable upon contact against the abutting part 125. The contact of the leaf spring 135 against the abutting part 125 is an example of an external force applied to the urging member.

In a state shown in FIG. 5 (when the movable member 63 is at the first position), the contact part 98 abuts against the abutting part 125 of the cartridge-receiving section 110. Specifically, the leading end of the contact part 98 abuts against the abutting part 125 of the cartridge-receiving section 110, thereby urging the movable member 63 to pivotally move clockwise in FIG. 5 (in the direction 57 in FIG. 4). That is, the movable member 63 that has abutted against the abutting part 125 is prevented from being applied with an urging force acting counterclockwise in FIG. 5 (in the direction 58 in FIG. 4).

Preferably, the contact part 98 is provided on the movable member 63. However, the contact part 98 may not be necessarily provided. Further, during insertion of the ink cartridge 30 into the cartridge-receiving section 110, the contact part 98 may abut against the abutting part 125 before or at the same time as the leaf spring 135 does.

In a state shown in FIG. 6 (when the movable member 63 is at the second position), the leaf spring 135 abuts against the abutting part of the cartridge-receiving section 110. At this time, a leading end portion 135A of the leaf spring 135 forms a curve whose radius of curvature is smaller than a radius of curvature thereof in a state shown in FIG. 5 where the leaf spring 135 does not abut against the abutting part 125. That is, the leaf spring 135 is resiliently deformed in the state shown in FIG. 6. This resilient deformation of the leaf spring 135 generates an urging force that urges the movable member 63 as a whole in the direction 57 (refer to FIG. 4), i.e., in the rearward direction 52. In other words, an urging force that urges the detected part 133 toward the third position is generated in the leaf spring 135.

Note that the urging force of the leaf spring 135 that urges the detected part 133 toward the third position is larger than the urging force of the weight part 134 that urges the detected part 133 toward the first position.

With the above-described configuration, the leaf spring 135 can change its state between the state illustrated in FIG. 6 where the urging force is generated (deformed state) and the state illustrated in FIG. 5 where the urging force is not generated (non-deformed state).

<Contact Member 64>

As illustrated in FIGS. 3 and 4, the contact member 64 is also accommodated in the cartridge body 61. The contact member 64 is disposed further in the leftward direction 56 (i.e., leftward) relative to the reservoir 62 within the cartridge body 61. The contact member 64 includes a first part 92 (an example of a first part) and a second part 93 (an example of a second part).

The first part 92 has a plate-like shape extending in the frontward direction 51 and rearward direction 52 as well as in the upward direction 54 and downward direction 53. The first part 92 is bonded to an outer surface of the film 88. That is, the first part 92 is in contact with the surface (left surface) of the reservoir 62. Put another way, the film 88 supports the first part 92.

The second part 93 extends from an upper-front end portion of the first part 92 in the frontward direction 51 along the film 88. In a side view, a leading end portion of the second part 93 does not overlap with the reservoir 62, as shown in FIG. 4. In other words, the leading end portion of the second part 93 protrudes frontward relative to the reservoir 62 in a side view. The second part 93 has a plate-like shape extending in the frontward direction 51 and rearward direction 52 as well as in the upward direction 54 and downward direction 53.

The second part 93 includes a bent part 95 (an example of a bent part) and the pair of projections 94. The bent part 95 and projections 94 are provided on the leading end portion of the second part 93.

The bent part 95 extends in the rightward direction 55 (i.e., toward the movable member 63) from the extending leading portion of the second part 93. The bent part 95 has a plate-like shape extending in the rightward direction 55 and leftward direction 56 as well as in the upward direction 54 and downward direction 53. The bent part 95 is located further in the rearward direction 52 (i.e., rearward) relative to the extending part 132 of the movable member 63. The bent part 95 has a front surface 95A that can abut against the extending part 132. Specifically, as shown in FIG. 6, the front surface 95A abuts against the extending part 132 when the detected part 133 is at the second position. By abutting against the extending part 132, the front surface 95A of the bent part 95 can restrict the movable member 63 from pivoting in the direction 57 (see FIG. 4). In other words, the front surface 95A of the bent part 95 in contact with the extending part 132 of the movable member 63 restricts the detected part 133 at the second position from moving toward the third position.

The projections 94 project in the upward direction 54 and downward direction 53, respectively, from respective upper and lower surfaces of the second part 93. The projections 94 are provided further in the rearward direction 52 (i.e., rearward) relative to the bent part 95. The projections 94 are aligned each other in the upward direction 54 and downward direction 53. The projections 94 are respectively fitted into the concave parts 89A formed in the protruding parts 89 constituting the cartridge body 61. With this structure, the contact member 64 can pivot in a direction denoted by an arrow 96 (direction 96, see FIG. 8A) about an axis defined by the projections 94.

Figure 8A:
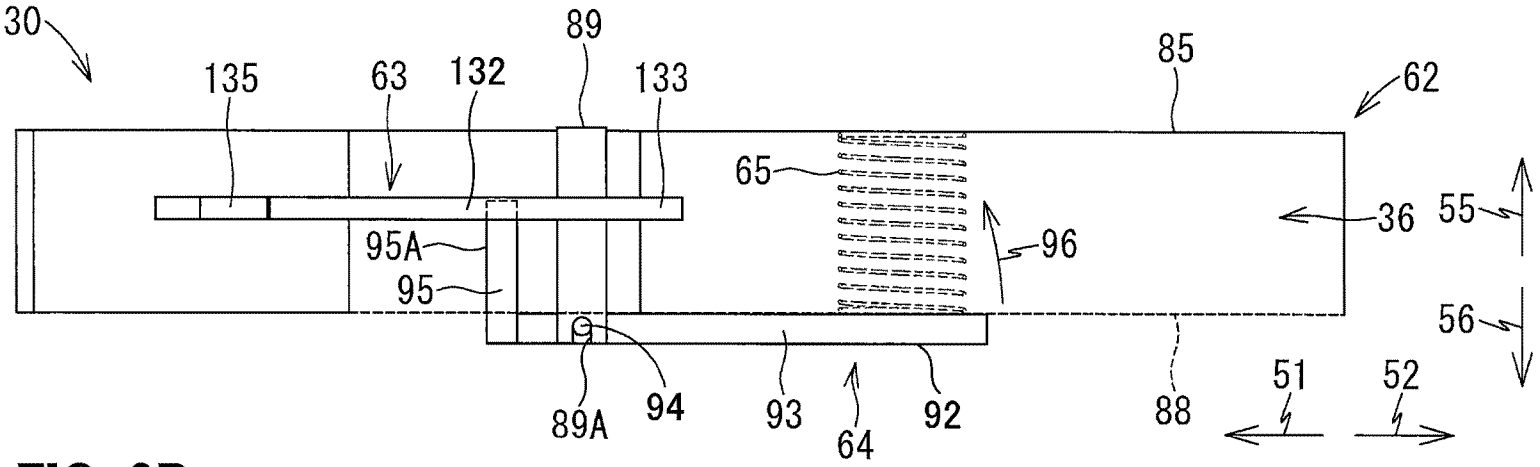
FIG. 8A is a view explaining movements of a contact member 64 in the ink cartridge 30, wherein a film 88 constituting the ink cartridge 30 is not deformed.
Figure 8B:
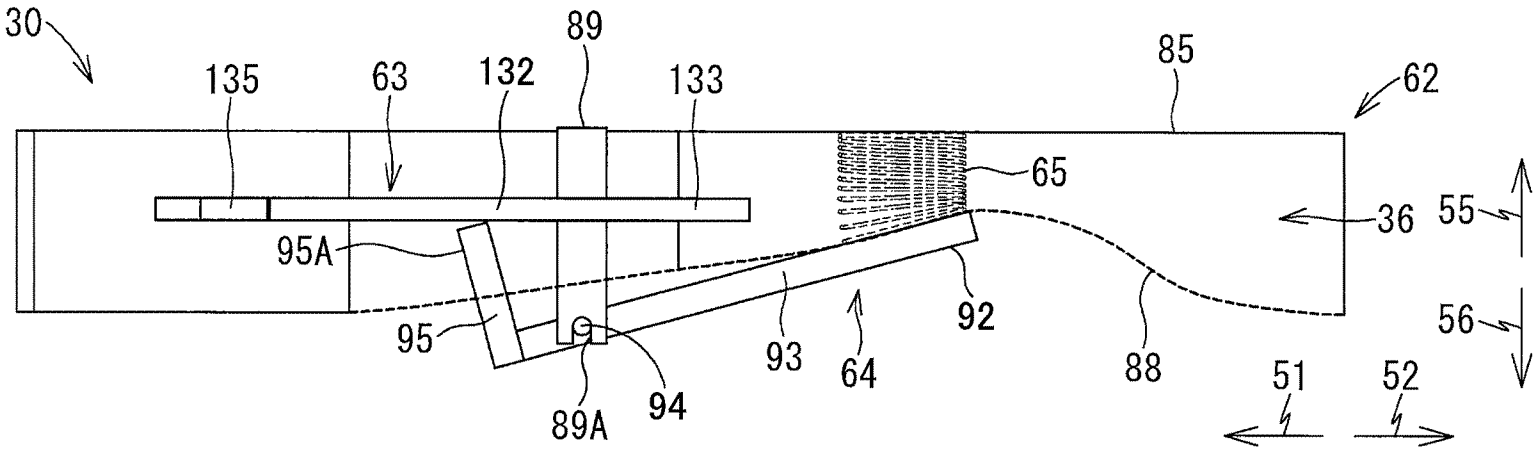
FIG. 8B is a view explaining movements of the contact member 64 in the ink cartridge 30, wherein the film 88 is deformed to be recessed inward.

As illustrated in FIG. 8A, when a sufficient amount of ink is left in the ink chamber 36, the film 88 is stretched in the frontward direction 51 and rearward direction 52, upward direction 54 and downward direction 53 by a biasing force of the coil spring 65, as will be described later. Accordingly, the first and second parts 92 and 93 of the contact member 64 are kept to extend in the frontward direction 51, rearward direction 52, upward direction 54 and downward direction 53. As the amount of ink left in the ink chamber 36 decreases, pressure within the ink chamber 36 also decreases correspondingly. Thus, as illustrated in FIG. 8B, the film 88 is deformed to be recessed (contracted) in the rightward direction 55 against the biasing force of the coil spring 65. Accordingly, the contact member 64 is made to pivot in the direction 96 in association with rightward movement of the first part 92 attached to the film 88, causing the bent part 95 of the second part 93 to move in the leftward direction 56 (i.e., away from the movable member 63). The bent part 95 thus separates from the extending part 132 of the movable member 63.

<Coil Spring 65>

As illustrated in FIGS. 8A and 8B, the coil spring 65 is disposed inside the ink chamber 36. Specifically, the coil spring 65 has one end connected to the right side wall 85, and another end connected to an inner surface of the film 88. The coil spring 65 and the first part 92 of the contact member 64 nip the film 88 therebetween. The coil spring 65 biases the film 88 in the leftward direction 56. The biasing force of the coil spring 65 is smaller than a negative pressure to be generated within the ink chamber 36 in association with reduction in the residual amount of ink in the ink chamber 36.

<Controller 1>

Figure 9:
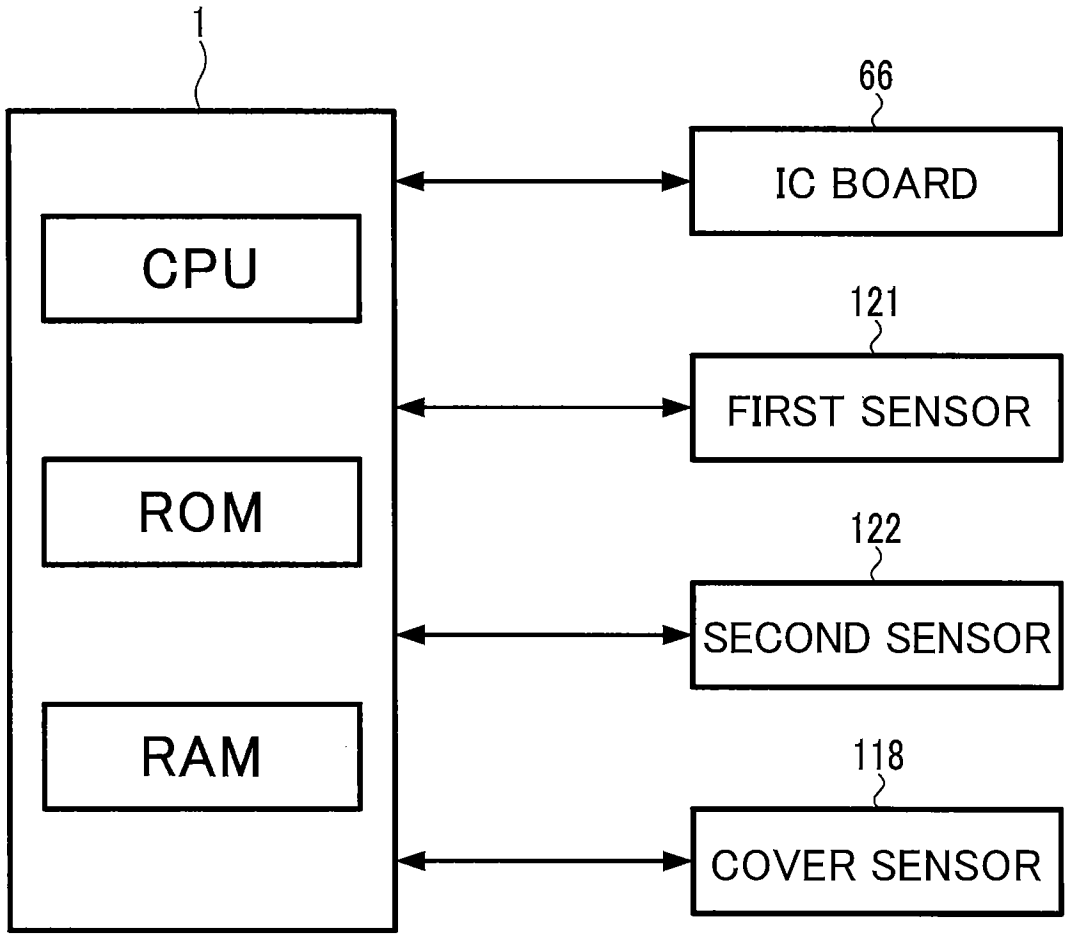
FIG. 9 is a block diagram showing interactions of a controller 1.
Figure 10A:
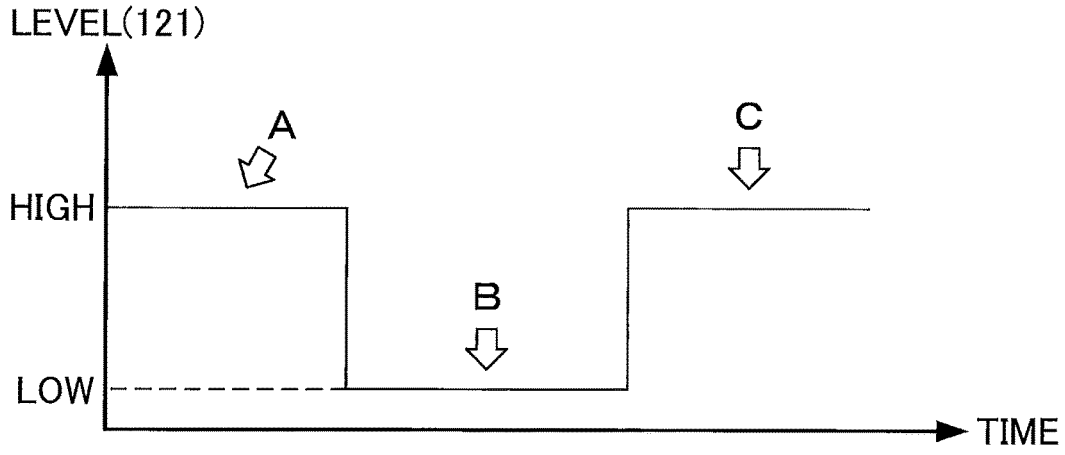
FIG. 10A is a timing chart illustrating changes in a signal outputted from a first sensor 121 during insertion of the ink cartridge 30 of the first embodiment.
Figure 10B:
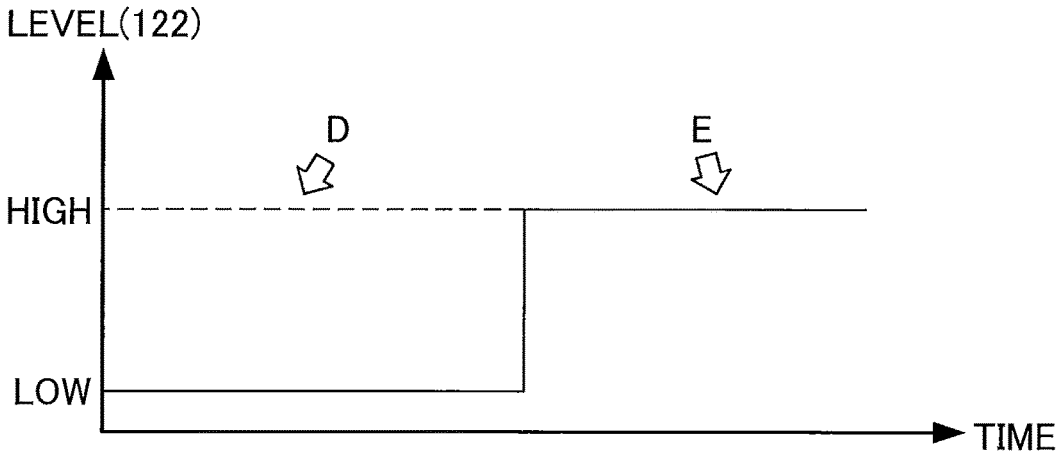
FIG. 10B is a timing chart illustrating changes in a signal outputted from a second sensor 122 in accordance with decrease in an amount of ink stored in the ink cartridge 30 of the first embodiment.

The printer 10 includes the controller 1 shown in FIG. 9. The controller 1 includes a CPU, a ROM and a RAM, for example. The controller 1 may be disposed within a housing of the printer 10 in a form of a control board to function as a controller of the printer 10. Alternatively, the controller 1 may be disposed on the case 101 in a form of a control board independent of the controller of the printer 10. The controller 1 is connected to the IC board 66, first sensor 121, and second sensor 122 so as to be capable of transmitting/receiving electrical signals therewith. Although not illustrated in FIG. 9, the controller 1 is also connected to other components such as a motor and a touch panel so as to be capable of transmitting/receiving electrical signals therewith. The ROM stores a program to enable the controller 1 to execute various processing. The CPU performs computation for executing various processing based on the program stored in the ROM and issues instructions to the components connected to the controller 1. The RAM functions as a memory for temporarily storing various information therein.

The controller 1 is configured to detect that the ink cartridge 30 has been attached to the cartridge-receiving section 110 upon detecting that a signal transmitted from the first sensor 121 has changed from high level to low level. Further, the controller 1 is configured to detect that the ink stored in the ink chamber 36 is running out upon detecting that a signal transmitted from the second sensor 122 has changed from low level to high level.

<Movements of the Movable Member 63 and Contact Member 64>

Now, movements of the movable member 63 and contact member 64 will be described with reference to FIGS. 5 to 10B.

First, how the movable member 63 and contact member 64 move during insertion of the ink cartridge 30 into the cartridge-receiving section 110 will be described.

As illustrated in FIG. 4, before the ink cartridge 30 is inserted into the cartridge-receiving section 110, the weight part 134 urges the movable member 63 in the direction 58 to bring the movable member 63 into the position shown in FIG. 4. At this time, the detected part 133 of the movable member 63 is at its first position. In this state, the valve in the ink supply part 34 is closed, thereby blocking ink flow from the ink chamber 36 to outside of the ink cartridge 30. Further, as illustrated in FIG. 2, before insertion of the ink cartridge 30 into the cartridge-receiving section 110, the movable member 63 is not located between the light-emitting part 123 and light-receiving part of the first sensor 121. Thus, as indicated by an arrow A in FIG. 10A, a high-level signal is transmitted from the first sensor 121 to the controller 1 (see FIGS. 1 and 9).

Note that, before insertion of the ink cartridge 30 into the cartridge-receiving section 110, the movable member 63 is not located between the light-emitting part 124 and light-receiving part of the second sensor 122, either. Therefore, a high-level signal is transmitted from the second sensor 122 to the controller 1, although not shown in the drawings.

Subsequently, the cover of the cartridge-receiving section 110 is opened and the ink cartridge 30 is inserted into the cartridge-receiving section 110 as illustrated in FIG. 5. During this insertion process, the detected part 133 of the movable member 63 at the first position comes to a position between the light-emitting part 123 and light-receiving part of the first sensor 121. Thus, the detected part 133 blocks the light emitted from the light-emitting part 123 of the first sensor 121. As indicated by an arrow B in FIG. 10A, the signal transmitted from the first sensor 121 to the controller 1 is changed from high level to low level.

When the ink cartridge 30 is further inserted into the cartridge-receiving section 110 from the state shown in FIG. 5, the leading end portion 135A of the leaf spring 135 abuts against the abutting part 125. Accordingly, the radius of curvature provided by the curved leading end portion 135A becomes smaller, generating the urging force in the leaf spring 135 to pivotally move the movable member 63 in the direction 57 (see FIG. 4). Accordingly, the detected part 133 of the movable member 63, which has blocked the light from the light-emitting part 123 of the first sensor 121, moves from the first position to the second position. As a result, in the first sensor 121, the light emitted from the light-emitting part 123 is no longer blocked by the detected part 133, and is received at the light-receiving part. Hence, as indicated by an arrow C in FIG. 10A, the signal transmitted from the first sensor 121 to the controller 1 is changed again from low level to high level.

As illustrated in FIG. 6, when the detected part 133 of the movable member 63 has reached the second position, the extending part 132 abuts on the bent part 95 of the contact member 64. The movable member 63 is thus restricted from pivoting in the direction 57, thereby restricting the detected part 133 from moving into the third position.

In the second position, the detected part 133 is situated between the light-emitting part 124 and light-receiving part of the second sensor 122. Thus, the detected part 133 blocks the light emitted from the light-emitting part 124, and a low-level signal is transmitted from the second sensor 122 to the controller 1, although not shown in the drawings.

When the ink cartridge 30 has moved further in the frontward direction 51 from the position illustrated in FIG. 5, the ink needle 102 enters the inner space of the ink supply part 34 through the ink supply port 71. The entered ink needle 102 pushes the valve to open the same, thereby allowing the ink stored in the ink chamber 36 to flow into the ink tube 20 through the inner space of the ink supply part 34 and the internal space 104 of the ink needle 102. In the state illustrated in FIG. 6, the ink cartridge 30 has been completely attached to the cartridge-receiving section 110 and is in its mounted posture (attached posture). Finally, the cover of the cartridge-receiving section 110 is closed.

Figure 11:
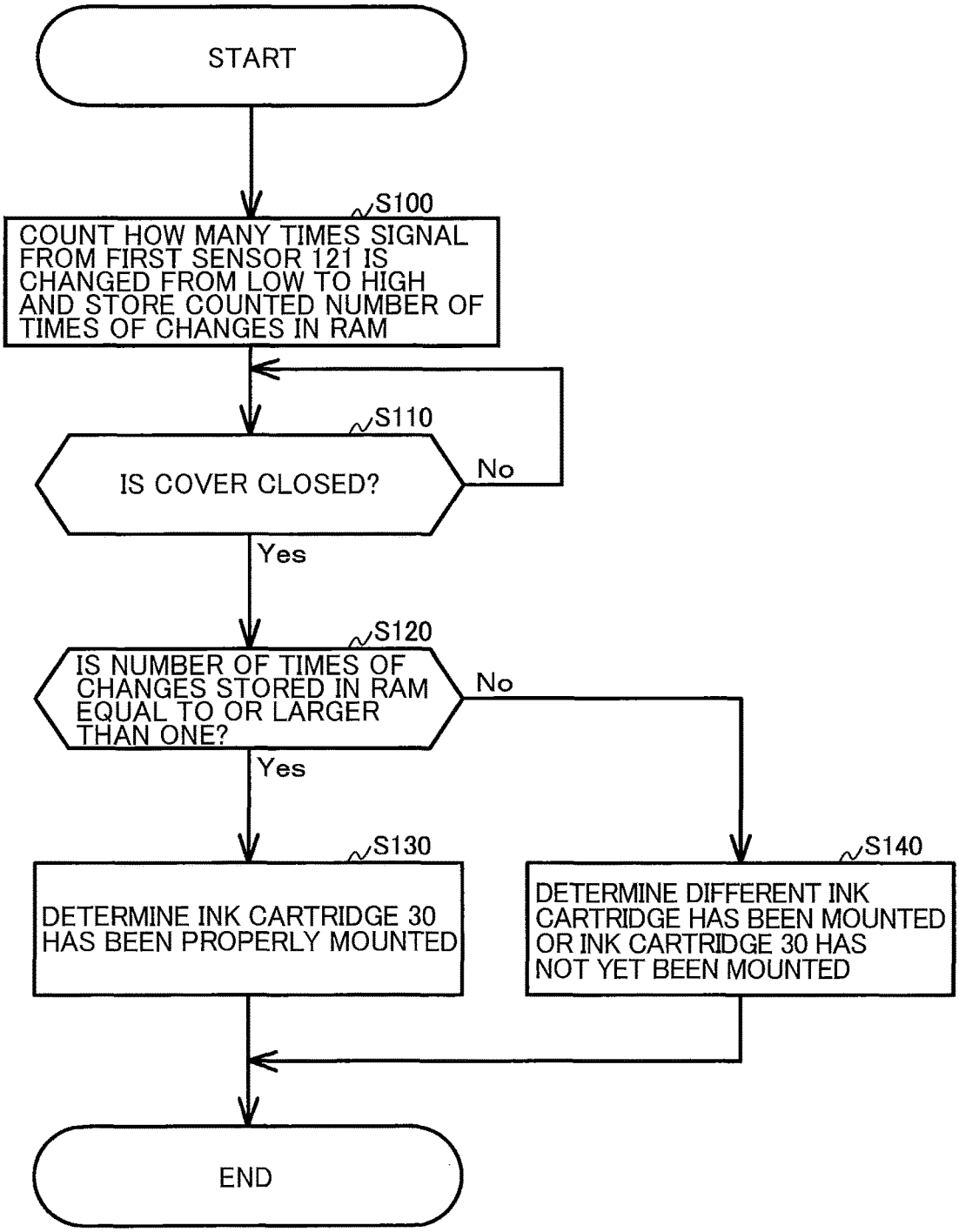
FIG. 11 is a flowchart explaining processes performed by the controller 1 to determine whether the ink cartridge 30 according to the first embodiment has been mounted in the cartridge-receiving section 110.

How the controller 1 detects the insertion of the ink cartridge 30 into the cartridge-receiving section 110 will be described next with reference to the flowchart of FIG. 11.

First, in S100, the controller 1 counts how many times the signal transmitted thereto from the first sensor 121 is changed from low level to high level since the cover of the cartridge-receiving section 110 was opened until the cover of the cartridge-receiving section 110 is closed. The controller 1 also stores data indicative of the result of the counting in the RAM in S100.

The controller 1 then determines in S110 whether or not the cover of the cartridge-receiving section 110 is closed. The controller 1 repeats the process of S110 until detecting that the cover of the cartridge-receiving section 110 is closed (S110: NO). When the controller 1 determines in S110 that the cover of the cartridge-receiving section 110 is closed (S110: YES), in S120 the controller 1 refers to the data stored in the RAM (the data indicating the number of times of changes in the signal from low to high in the first sensor 121).

When the number of times is equal to or larger than 1 (S120: YES), the controller 1 determines in S130 that the ink cartridge 30 has been properly attached to the cartridge-receiving section 110. On the other hand, when the number of times is zero (S120: NO), the controller 1 determines in S140 that: an ink cartridge different from the ink cartridge 30 has been attached to the cartridge-receiving section 110; or the ink cartridge 30 has not been attached to the cartridge-receiving section 110. If this is the case (if the process goes to S140), the controller 1 may issue a message prompting the user to attach the ink cartridge 30, for example.

Next, movements of the movable member 63 and contact member 64 when the amount of ink left in the ink chamber 36 becomes smaller will be described with reference to FIGS. 6 to 8B and 10B.

As illustrated in FIG. 6, when the residual amount of ink in the ink chamber 36 is sufficient, the detected part 133 of the movable member 63 is positioned between the light-emitting part 124 and light-receiving part of the second sensor 122, thereby blocking the light from the light-emitting part 124. Thus, as indicated by an arrow D in FIG. 10B, a low-level signal is transmitted from the second sensor 122 to the controller 1.

As the ink stored in the ink chamber 36 is consumed from the state illustrated in FIG. 6 and the amount of ink left in the ink chamber 36 decreases, the film 88 is deformed to be recessed in the rightward direction 55 as illustrated in FIG. 8B. With this deformation of the film 88, the contact member 64 is pivotally moved in the direction 96 (see FIG. 8A), which moves the bent part 95 of the contact member 64 in the leftward direction 56, as shown in FIG. 8B. Since the bent part 95 of the second part 93 is now located further in the leftward direction 56 (i.e., leftward) relative to the extending part 132, abutment of the extending part 132 against the bent part 95 is now released. That is, the bent part 95 is separated from the extending part 132. Accordingly, the movable member 63 is caused to pivot in the direction 57 due to the urging force of the leaf spring 135, thereby moving the detected part 133 into the third position shown in FIG. 7 from the second position.

In the third position, the detected part 133 does not block the light emitted from the light-emitting part 124 of the second sensor 122. Thus, as indicated by an arrow E in FIG. 10B, the signal transmitted from the second sensor 122 to the controller 1 is changed from low level to high level. The controller 1 can thus detect that a small amount of ink is left in the ink chamber 36, i.e., the residual amount of ink in the ink chamber 36 is smaller than a predetermined amount.

Note that part of the detected part 133 that blocks the light from the first sensor 121 is different from the part of the detected part 133 that blocks the light from the second sensor 122 in this embodiment. However, the detected part 133 may block the light from both of the first and second sensors 121 and 122 at the same position.

Operational and Technical Advantages of the First Embodiment

According to the structure of the first embodiment, the detected part 133 at the first position can be moved to the second position by the urging force generated in the leaf spring 135. Further, the detected part 133 at the second position is restricted from moving to the third position by the contact member 64. Further, as the contact member 64 moves in accordance with the deformation of the reservoir 62, the abutment of the movable member 63 against the contact member 64 is released, thereby enabling the detected part 133 to move from the second position to the third position by the biasing force of the leaf spring 135. By detecting the detected part 133, two types of detections can be performed regarding states (status) of the ink cartridge 30. Thus, this structure can reduce the number of components required for detection in the ink cartridge 30.

Further, the detected part 133 protrudes in the upward direction 54 relative to the cartridge body 61 in the ink cartridge 30 of the first embodiment. This structure can reduce a possibility that ink splashing from the ink supply part 34 may adhere to the detected part 133, thereby suppressing occurrence of incorrect detection with respect to the detected part 133.

In particular, compared to a case where a detection window is formed in an ink cartridge for detecting a residual amount of ink, the structure of the first embodiment without providing a detection window is more advantageous in achieving accurate detection, since the detected part 133 is exposed outside the cartridge body 61 and thus is less likely to get contaminated by ink.

Further, since the movable member 63 is configured to pivotally move, two types of detections can be performed for the states of the ink cartridge 30 with a simple configuration.

Further, the center of the shaft hole 131, i.e., the axis X of the shaft bar 87 (pivot axis of the movable member 63) is positioned on the perpendicular bisector 136 of the line segment connecting the center 133A of the detected part 133 at the first position and the center 133B of the detected part 133 at the second position. With this configuration, the movable member 63 can be made movable by a larger amount with respect to a linear distance between the first position and second position.

Further, the urging force is generated in the leaf spring 135 by resilient deformation thereof. This structure can facilitate movement of the detected part 133 to the third position.

Further, due to provision of the weight part 134, the movable member 63 can be retained at the first position when the urging force is not generated in the leaf spring 135, for example, when the ink cartridge 30 is detached from the cartridge-receiving section 110.

Further, since the weight part 134 is disposed further in the frontward direction 51 relative to the shaft hole 31, the weight part 134 can urge the detected part 133 in the frontward direction 51 to maintain the detected part 133 in the first position.

Further, the detected part 133 is not housed inside the cartridge body 61 but is located outside of the cartridge body 61 in the present embodiment. Hence, the detected part 133 can be easily detected by the first sensor 121 and second sensor 122.

Further, the bent part 95 of the contact member 64 can make contact with the movable member 63 with a large area. Hence, in a configuration where the bent part 95 is designed to contact the movable member 63, this structure of the first embodiment can suppress unintentional disengagement of the movable member 63 from the contact member 64.

2. Second Embodiment

Next, an ink cartridge 230 according a second embodiment of the disclosure will be described with reference to FIGS. 12A through 14. In the following description, like parts and components are designated with the same reference numerals as those of the first embodiment to avoid duplicating explanation.

While the movable member 63 of the first embodiment is configured to make pivotal movement, a movable member 263 of the second embodiment is configured make movement other than pivotal movement.

Figure 12A:
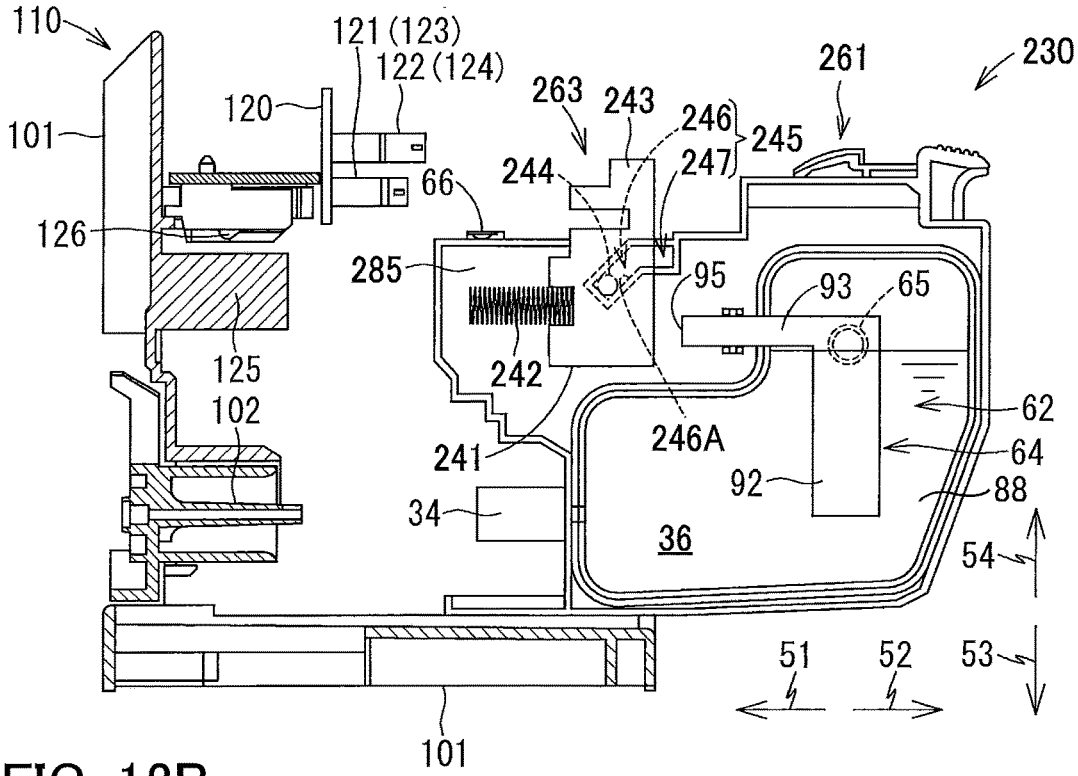
FIG. 12A is a vertical cross-sectional view showing the cartridge-receiving section 110 and an ink cartridge 230 according to a second embodiment, wherein a detected part 243 is at a first position and a coil spring 242 is not yet brought into contact with an abutting part 125 of the cartridge-receiving section 110.
Figure 12B:
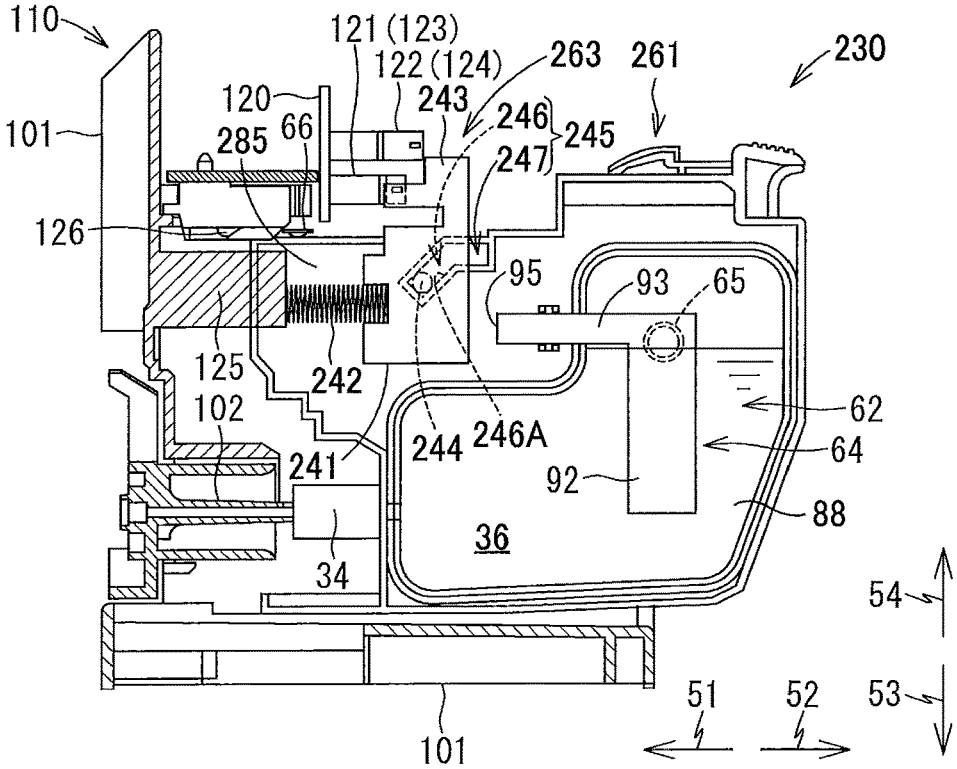
FIG. 12B is a vertical cross-sectional view showing the cartridge-receiving section 110 and the ink cartridge 230 according to the second embodiment, wherein the detected part 243 is at the first position and the coil spring 242 contacts the abutting part 125.

Specifically, the ink cartridge 230 of the second embodiment includes a cartridge body 261 similar to the cartridge body 61 of the first embodiment, the contact member 64 and the movable member 263, as shown in FIGS. 12A and 12B.

The movable member 263 includes a main body 241, a coil spring 242. The coil spring 242 is arranged to extend in the frontward direction 51 from a front surface of the main body 241.

The main body 241 includes a detected part 243 and a projection 244. The detected part 243 constitutes an upper end portion of the main body 241. The projection 244 projects in the rightward direction 55 from a right surface of the main body 241. The projection 144 is engaged with an elongated hole 245 formed in a right side wall 285 constituting the cartridge body 261. The projection 244 is thus movable along the elongated hole 145. The elongated hole 245 includes a sloped part 246 and a horizontal part 247. The sloped part 246 slopes in the upward direction 54 as extending further in the rearward direction 52. That is, the sloped part 246 extends diagonally upward toward the rear. The horizontal part 247 extends in the rearward direction 52 from a rear end of the sloped part 246. The sloped part 246 includes a surface 246A that defines the rear end of the sloped part 246.

The first and second sensors 121 and 122 are arranged to be vertically aligned with each other in the second embodiment. Further, as in the first embodiment, the first sensor 121

(light-emitting part 123) is disposed further in the forward direction 51 (i.e., frontward) relative to the second sensor 122 (light-emitting part 124).

Hereinafter, movements of the movable member 263 of the second embodiment will be described. Note that, since the operations of the ink supply part 34 are the same as those in the first embodiment, descriptions thereof will be omitted.

In the ink cartridge 230 before being inserted into the cartridge-receiving section 110, the movable member 263 is fixed to the cartridge body 261 by an adhesive tape and the like, thereby being maintained at a position shown in FIG. 12A. In this state, the projection 244 is positioned at a lower-front end of the sloped part 246. The location of the detected part 243 at this time (shown in FIG. 12A) is a first position. At this time, the sloped part 246A of the sloped part 246 supports the projection 244.

Incidentally, in the cartridge-receiving section 110 before receiving the ink cartridge 230, nothing is present between the light-emitting part 123 and light receiving part of the first sensor 121, nor between the light-emitting part 124 and light receiving part of the second sensor 122. That is, the detected part 243 does not block the light in both of the first and second sensors 123 and 124. Hence, a high-level signal is transmitted from the first and second sensors 121 and 122 to the controller 1 (refer to FIG. 1).

Then, when the ink cartridge 230 is being inserted into the cartridge-receiving section 110 as illustrated in FIG. 12B, the detected part 243 at the first position comes to a position between the light-emitting part 123 and light-receiving part of the first sensor 121. Thus, the detected part 243 at the first position blocks the light emitted from the light-emitting part 123 of the first sensor 121. As a result, the signal from the first sensor 121 transmitted to the controller 1 is now changed from high level to low level, and the controller 1 now detects that the ink cartridge 30 has been inserted into the cartridge-receiving section 110. At this time, a front end of the coil spring 242 is brought into abutment with the abutting part 125.

As the ink cartridge 230 at the position illustrated in FIG. 12B is moved further in the frontward direction 51, the coil spring 242 is contracted, thereby generating an urging force that urges the movable member 263 in the rearward direction 52. Note that, in a state where the coil spring 242 is slightly contracted, the generated urging force of the coil spring 242 is still smaller than a force with which the surface 246A supports the projection 244. Accordingly, the movable member 263 is retained at the current position (the position of the projection 244 situated at the lower-front end of the sloped part 246 of the elongated hole 245).

Figure 13A:
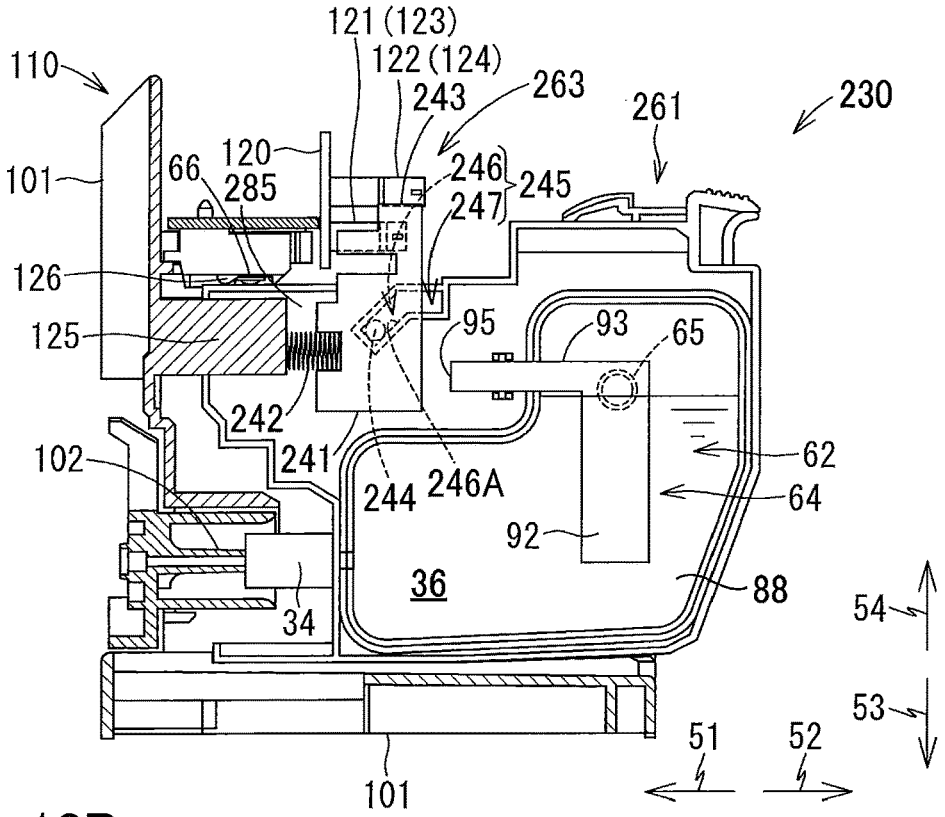
FIG. 13A is a vertical cross-sectional view showing the cartridge-receiving section 110 and the ink cartridge 230 according to the second embodiment, wherein the detected part 243 is at the first position and the coil spring 242 is contacted.

As the ink cartridge 230 is moved further in the frontward direction 51 to be completely mounted in the cartridge-receiving section 110, the coil spring 242 is further contracted, as shown in FIG. 13A. The urging force of the coil spring 242 has now become larger than the force with which the surface 246A supports the projection 244. Accordingly, the projection 244 is moved in the rearward direction 52 and in upward direction 54 along the sloped part 246. When the projection 244 reaches a front end of the horizontal part 247 (see FIG. 13B), the main body 241 of the movable member 263 abuts against the bent part 95 of the contact member 64. As a result, the movable member 263 is restricted from moving in the rearward direction 52. The position of the detected part 243 in this state (state illustrated in FIG. 13B) is a second position.

The detected part 243 at the second position is situated between the light-emitting part 124 and light-receiving part of the second sensor 122. That is, the detected part 243 at the second position blocks the light emitted from the light-emitting part 124 of the second sensor 122. Accordingly, a low-level signal is transmitted from the second sensor 122 to the controller 1.

Figure 13B:
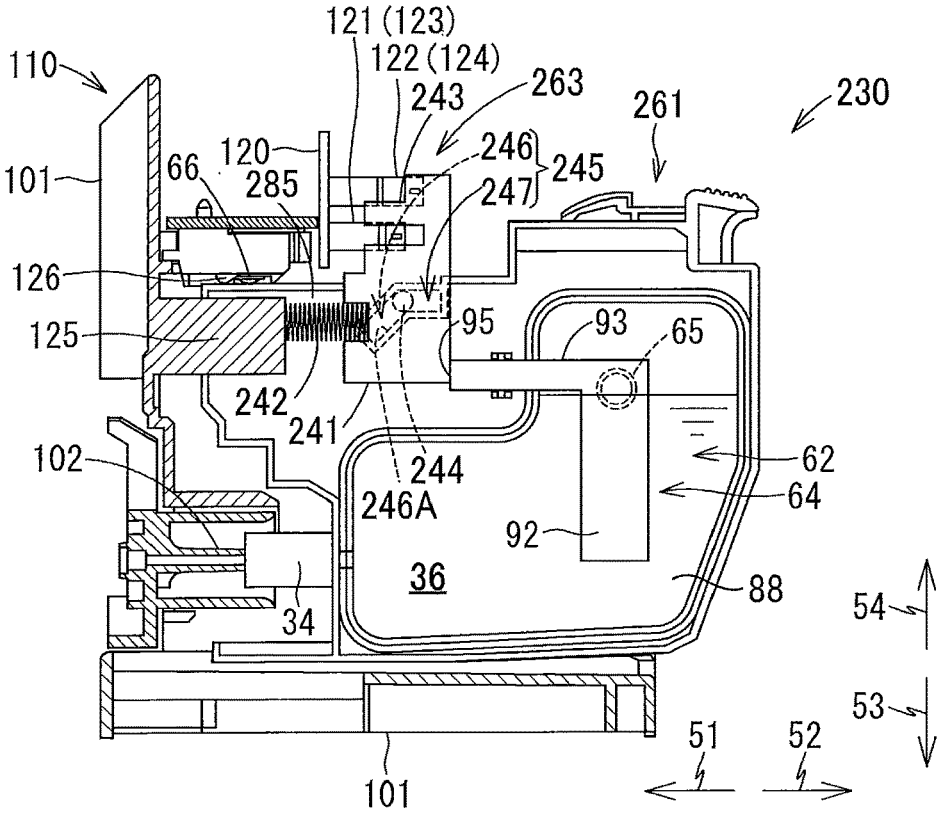
FIG. 13B is a vertical cross-sectional view showing the cartridge-receiving section 110 and the ink cartridge 230 according to the second embodiment, wherein the detected part 243 is at a second position.
Figure 14:
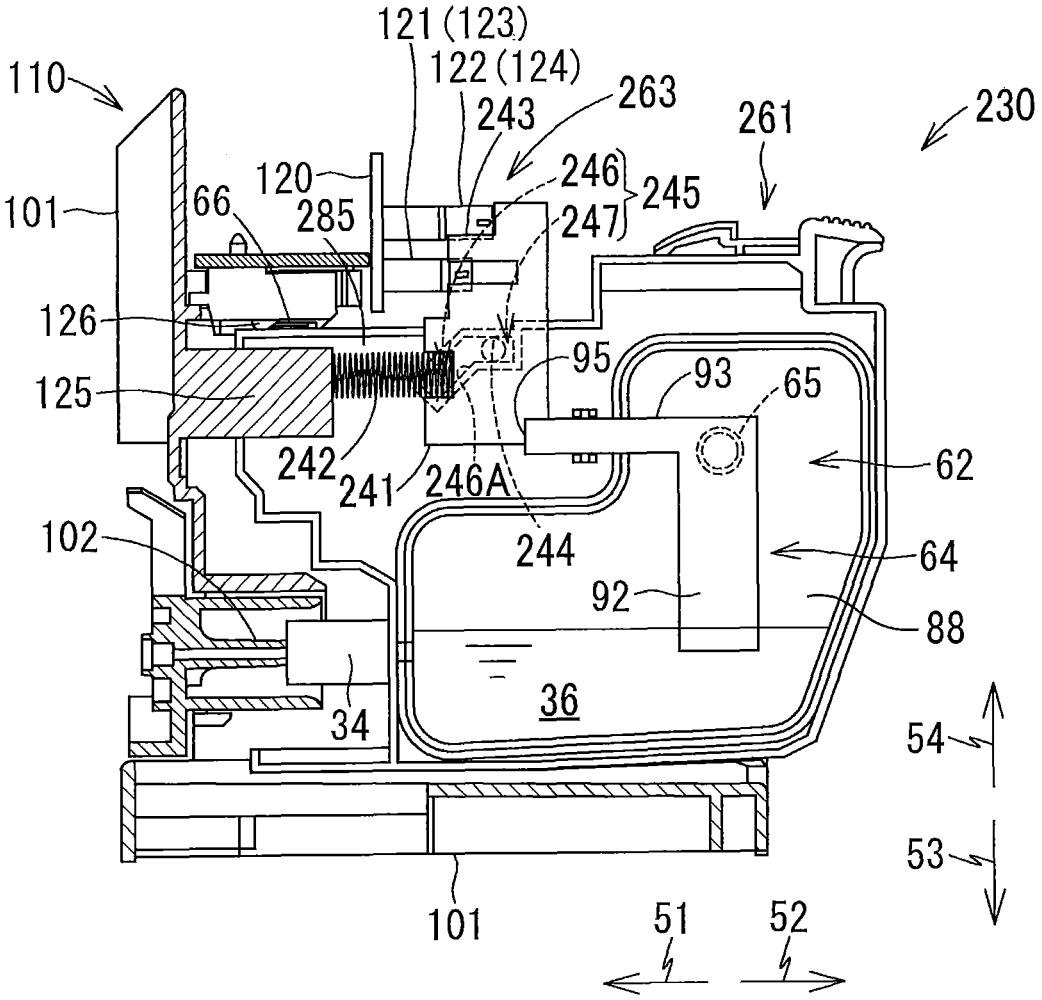
FIG. 14 is a vertical cross-sectional view showing the cartridge-receiving section 110 and the ink cartridge 230 according to the second embodiment, wherein the detected part 243 is at a third position.

When ink stored in the ink chamber 36 is consumed from the state illustrated in FIG. 13B, i.e., when the amount of ink in the ink chamber 36 is reduced, the film 88 is deformed to be recessed (deflate) in the rightward direction 55. Accordingly, the contact member 64 is pivoted such that contact of the bent part 95 with the main body 241 is now released. The projection 244 is then moved in the rearward direction 52 along the horizontal part 247 of the elongated hole 245 due to the urging force of the coil spring 242. That is, the movable member 263 is moved in the rearward direction 52 by the urging force of the coil spring 242, as shown in FIG. 14. In this state illustrated in FIG. 14, the detected part 243 is located at its third position.

The detected part 243 at the third position does not block the light emitted from the light-emitting part 124 of the second sensor 122. Thus, the low-level signal from the second sensor 122 to the controller 1 is changed to a high-level signal, and the controller 1 detects that a little amount of ink has now been left in the ink chamber 36.

3. Other Variations and Modifications

While leaf spring 135 is employed as the first biasing member in the first embodiment, the first biasing member the present disclosure is not limited to the leaf spring 135. For example, the first biasing member may be realized by a coil spring attached to the extending part 132 of the movable member 63.

Further, instead of the weight part 134 of the first embodiment, a coil spring may be employed as the second biasing member, for example. In this case, one end of the coil spring may be attached to the extending part 132 of the movable member 63, while the other end of the coil spring may be attached to the cartridge body 61. This structure can also allow the movable member 63 to be biased in the direction 58 in FIG. 4.

Further, in the first embodiment, the movable member 63 includes the weight part 134. However, the movable member 63 need not include the weight part 134. In case that the movable member 63 does not include the weight part 134, the movable member 63 may be fixed to the cartridge body 61 by an adhesive tape or the like to be maintained at the position shown in FIG. 4 in a state where the ink cartridge 30 is not yet mounted in the cartridge-receiving section 110. Then, during insertion of the ink cartridge 30 into the cartridge-receiving section 110, the adhesive tape's fixing of the movable member 63 to the cartridge body 61 is released by the urging force of the leaf spring 135.

While the ink cartridge 30, 230 is attached to the cartridge-receiving section 110 in the horizontal direction in the first and second embodiments, the ink cartridge 30, 230 may be necessarily to be mounted horizontally. For example, the ink cartridge 30, 230 may be configured to be inserted vertically into the cartridge-receiving section 110. In this case, arrangements and moving directions of the movable member 63, contact member 64, movable member 263, and the like may be changed appropriately depending on the direction in which the ink cartridge 30, 230 is inserted.

Further, while ink serves as an example of the liquid in the depicted embodiments, the liquid of the present disclosure is not limited to ink. For example, the liquid may be a pretreatment liquid that is ejected onto sheets prior to ink during a printing operation.

What is claimed is:

1. A liquid cartridge comprising:

a cartridge body comprising an upper wall formed with a through-hole therein, the cartridge body accommodating a reservoir configured to store liquid therein, the reservoir being deformable;

a liquid-supply part provided on the cartridge body and configured to allow the liquid stored in the reservoir to flow out therefrom;

a movable member movably supported by the cartridge body and including a detected part subject to external detection, the detected part being movable from a first position, to a second position rearward of the first position, and to a third position rearward of the second position, the detected part at the first position and at the second position being positioned higher relative to the cartridge body;

an urging member provided on the movable member, the urging member being resiliently deformable and movable between a non-deformed state and a deformed state, the urging member in the deformed state being deformed to generate an urging force to urge the detected part toward the third position; and a contact member provided at a surface of the reservoir and configured to contact the movable member, the contact member in contact with the movable member restricting the detected part at the second position from moving to the third position, wherein the movable member further comprises:

an accommodated portion accommodated in the cartridge body at a position different from the reservoir; and a protruding portion extending upward from the accommodated portion through the through-hole, the protruding portion including the detected part.

2. The liquid cartridge as claimed in claim 1, wherein the movable member is pivotable about a pivot axis, the detected part being movable from the first position, to the second position and to the third position in accordance with pivotal movement of the movable member.

3. The liquid cartridge as claimed in claim 2, wherein the pivot axis is defined by a pivot shaft, the urging member being positioned upward relative to the pivot shaft.

4. The liquid cartridge as claimed in claim 2, wherein the detected part is pivotable between the first position and the second position downward relative to the first position.

5. The liquid cartridge as claimed in claim 2, wherein the movable member comprises an extending part extending in an extending direction, the extending part having one end and another end opposite the one end in the extending direction, the one end defining the pivot axis, the another end including the detected part, and wherein the urging member is provided on the extending part to extend frontward therefrom, the extending part contacting the contact member with the detected part at the second position.

6. The liquid cartridge as claimed in claim 2, wherein the detected part at the first position defines a first center thereof and the detected part at the second position defines a second center thereof, the pivot axis being located on a perpendicular bisector of a line segment connecting between the first center and the second center.

7. The liquid cartridge as claimed in claim 1, wherein the urging member comprises a leaf spring.

8. The liquid cartridge as claimed in claim 7, wherein the leaf spring extends frontward and downward and is curved such that the leaf spring is resiliently deformable upon receipt of an external force.

9. The liquid cartridge as claimed in claim 8, wherein the leaf spring is resiliently deformed when contacted from outside.

10. The liquid cartridge as claimed in claim 1, further comprising another urging member configured to apply an urging force to the detected part to urge the detected part toward the first position, the urging force of the another urging member being smaller than the urging force of the urging member.

11. The liquid cartridge as claimed in claim 10, wherein the movable member is pivotable about a pivot axis, the detected part being movable from the first position, to the second position and to the third position in accordance with pivotal movement of the movable member, and wherein the another urging member is disposed frontward relative to the pivot axis.

12. The liquid cartridge as claimed in claim 1, wherein the contact member further comprises:

a first part in contact with the surface of the reservoir;

a second part extending in a particular direction from the first part along the surface of the reservoir, the second part having a free end protruding in the particular direction relative to the reservoir in a side view; and a bent part arranged on the free end of the second part, the bent part extending from the free end of the second part toward the movable member, the bent part contacting the movable member with the detected part at the second position.

13. The liquid cartridge as claimed in claim 12, wherein the surface of the reservoir faces in a direction orthogonal to the particular direction and away from the movable member, the surface being covered with a flexible film, the flexible film being deformable in accordance with outflow of the liquid from the reservoir, and wherein the flexible film supports the first part of the contact member, the second part of the contact member moving in accordance with deformation of the flexible film to move the bent part away from the movable member to separate the bent part from the movable member.

14. The liquid cartridge as claimed in claim 12, wherein the surface of the reservoir is deformable in accordance with outflow of the liquid from the reservoir, and wherein the first part of the contact member is fixed to the surface of the reservoir.

15. The liquid cartridge as claimed in claim 14, wherein the bent part contacts the movable member to restrict the detected part at the second position from moving to the third position, and wherein the deformation of the surface of the reservoir separates the bent part from movable member to move the detected part at the second position to the third position due to the urging force of the urging member.

16. The liquid cartridge as claimed in claim 1, wherein the cartridge body comprises:

a front wall, the liquid-supply part being provided on the front wall;

a rear wall positioned to be separated from the front wall; and an upper wall connecting between the front wall and the rear wall, the detected part at the first position and at the second position being positioned higher relative to the upper wall of the cartridge body.

17. The liquid cartridge as claimed in claim 16, the liquid cartridge being configured to be inserted into and mounted in a cartridge-receiving section provided with a first optical sensor and a second optical sensor, wherein the detected part at the first position is configured to be detected by the first optical sensor during insertion of the liquid cartridge into the cartridge-receiving section, the detected part at the first position detected by the first optical sensor providing information on whether the liquid cartridge is mounted in the cartridge-receiving section, and wherein the detected part at the second position is configured to be detected by the second optical sensor upon completion of the mounting of the liquid cartridge in the cartridge-receiving section, the detected part having moved to the third position from the second position providing information on an amount of the liquid in the reservoir.

18. The liquid cartridge as claimed in claim 1, the liquid cartridge being configured to be inserted into and mounted in a cartridge-receiving section, the cartridge-receiving section defining a cartridge accommodation space therein and including a protruding part extending in a rearward direction within the cartridge accommodation space, wherein the cartridge body comprises:

a front wall at which the liquid-supply part is disposed, the front wall facing in a frontward direction opposite to the rearward direction;

a rear wall disposed in separation from the front wall; and an upper wall connecting between the front wall and the rear wall, and wherein the urging member is resiliently deformable in the frontward direction and in the rearward direction, the urging member moving from the non-deformed state to the deformed state upon contact against the protruding part during insertion of the liquid cartridge into the cartridge-receiving section, the urging member in the deformed state urging the detected part to move from the first position to the second position, the detected part at the second position being positioned closer to the rear wall than the detected part at the first position is to the rear wall.

19. The liquid cartridge as claimed in claim 18, wherein the urging force of the urging member in the deformed state moves the detected part from the second position to the third position, the detected part at the third position being positioned closer to the rear wall than the detected part at the second position is to the rear wall.

* * * * *